US012716142B2

(12) United States Patent
Patel et al.

(10) Patent No.: US 12,716,142 B2
(45) Date of Patent: Aug. 25, 2026

(54) VAPORIZER AND EXTERNAL STEAM FOR SOLID OXIDE ELECTROLYZER

(71) Applicant: Bloom Energy Corporation, San Jose, CA (US)

(72) Inventors: Siddharth Patel, San Jose, CA (US); Navaneethakrishnan Govindarasu, San Jose, CA (US); Andy Ta, San Jose, CA (US); David Weingaertner, San Jose, CA (US); Cory Mcclintic, San Jose, CA (US); Ryan Johnson, San Jose, CA (US); Samuel Juday, San Jose, CA (US); Kim Nguyen, San Jose, CA (US)

(73) Assignee: BLOOM ENERGY CORPORATION, San Jose, CA (US)

( * ) Notice: Subject to any disclaimer, the term of this patent is extended or adjusted under 35 U.S.C. 154(b) by 730 days.

(21) Appl. No.: 18/151,753

(22) Filed: Jan. 9, 2023

(65) Prior Publication Data

US 2023/0220577 A1 Jul. 13, 2023

Related U.S. Application Data

(60) Provisional application No. 63/297,608, filed on Jan. 7, 2022, provisional application No. 63/297,687, filed (Continued)

(51) Int. Cl.
*C25B 15/08* (2006.01)
*C25B 1/042* (2021.01)

(Continued)

(52) U.S. Cl.
CPC ..... *C25B 15/083* (2021.01); *C25B 1/042* (2021.01); *C25B 9/67* (2021.01); *C25B 9/77* (2021.01); *C25B 15/087* (2021.01)

(58) Field of Classification Search
None
See application file for complete search history.

(56) References Cited

U.S. PATENT DOCUMENTS

2005/0123814 A1* 6/2005 Calhoon ..... H01M 8/04037 429/432
2008/0023338 A1* 1/2008 Stoots ..... C25B 1/04 205/637

(Continued)

FOREIGN PATENT DOCUMENTS

CA 3165456 A1 * 8/2021 ..... C25B 1/042
EP 4086370 A2 11/2022

(Continued)

OTHER PUBLICATIONS

Search Report issued Jun. 14, 2023 in corresponding European Patent Application No. 23150761.7.

(Continued)

*Primary Examiner* — Harry D Wilkins, III
(74) *Attorney, Agent, or Firm* — THE MARBURY LAW GROUP PLLC

(57) ABSTRACT

An electrolyzer system including a hotbox, one or more stacks disposed within the hotbox, a fuel exhaust conduit that receives fuel exhaust output by the stack, a fuel exhaust separator that separates liquid from the fuel exhaust, and a recycling conduit that fluidly connects the fuel exhaust to the fuel inlet conduit.

13 Claims, 14 Drawing Sheets

700

Related U.S. Application Data on Jan. 7, 2022, provisional application No. 63/297,614, filed on Jan. 7, 2022, provisional application No. 63/297,602, filed on Jan. 7, 2022.

(51) Int. Cl.
*C25B 9/67* (2021.01)
*C25B 9/77* (2021.01)

(56) References Cited

U.S. PATENT DOCUMENTS

| | | | | |
|---|---|---|---|---|
| 2009/0325014 | A1* | 12/2009 | Newkirk | C25B 15/02 205/349 |
| 2011/0086280 | A1* | 4/2011 | Roustaei | B60L 58/30 204/230.2 |
| 2015/0368818 | A1* | 12/2015 | Pedersen | C25B 9/00 204/267 |
| 2016/0244890 | A1* | 8/2016 | Petipas | C25B 9/00 |
| 2017/0005357 | A1* | 1/2017 | Mermelstein | H01M 8/186 |
| 2017/0175277 | A1* | 6/2017 | von Olshausen | C25B 1/04 |
| 2019/0245224 | A1 | 8/2019 | Lacroix et al. | |
| 2020/0328445 | A1* | 10/2020 | Weingaertner | H01M 8/0668 |
| 2022/0372636 | A1* | 11/2022 | Weingaertner | C25B 9/67 |

FOREIGN PATENT DOCUMENTS

| | | | | |
|---|---|---|---|---|
| EP | 4105360 | A2 | 12/2022 | |
| EP | 4119699 | A1 | 1/2023 | |
| WO | 2014139822 | A1 | 9/2014 | |
| WO | WO-2021151453 | A1 * | 8/2021 | C01B 3/34 |

OTHER PUBLICATIONS

EPO Office Communication pursuant to article 94(3) EPC for European Patent Application No. 23153761.7, mailed Nov. 7, 2025, 5 pages.

* cited by examiner

300

700

800

900

1010

1020

1040

1050

1110

1120

1230

1230

VAPORIZER AND EXTERNAL STEAM FOR SOLID OXIDE ELECTROLYZER

FIELD OF THE INVENTION

The embodiments of the present invention are directed to electrolyzer systems including solid oxide electrolyzer cells (SOECs) and methods of operating the same.

BACKGROUND OF THE INVENTION

Solid oxide fuel cells (SOFC) can be operated as an electrolyzer in order to produce hydrogen and oxygen, referred to as solid oxide electrolyzer cells (SOEC). In SOFC mode, oxide ions are transported from the cathode side (air) to the anode side (fuel) and the driving force is the chemical gradient of partial pressure of oxygen across the electrolyte. In SOEC mode, a positive potential is applied to the air side of the cell and the oxide ions are now transported from the fuel side to the air side. Since the cathode and anode are reversed between SOFC and SOEC (i.e. SOFC cathode is SOEC anode, and SOFC anode is SOEC cathode), going forward, the SOFC cathode (SOEC anode) will be referred to as the air electrode, and the SOFC anode (SOEC cathode) will be referred to as the fuel electrode. During SOEC mode, water in the fuel stream is reduced ($H_2O+2e \rightarrow O^{2-}+H_2$) to form $H_2$ gas and $O^{2-}$ ions, $O^{2-}$ ions are transported through the solid electrolyte, and then oxidized on the air side ($O^{2-}$ to $O_2$) to produce molecular oxygen. Since the open circuit voltage for a SOFC operating with air and wet fuel (hydrogen, reformed natural gas) is on the order of 0.9 to 1V (depending on water content), the positive voltage applied to the air side electrode in SOEC mode raises the cell voltage up to typical operating voltages of 1.1 to 1.3V.

As discussed below, the various embodiments of the present invention generally relate to systems, devices, and methods of producing steam room liquid water as an inlet to the solid oxide electrolyzer (SOEC) hotbox to generate hydrogen.

SUMMARY OF THE INVENTION

Accordingly, the present invention is directed to vaporizer and external steam for electrolyzer that substantially obviates one or more problems due to limitations and disadvantages of the related art.

An object of the present invention is to provide configurations for one or more internal and/or external vaporizers.

Another object of the present invention is to provide configurations for internal steam or external steam.

Another object of the present invention is to provide configurations for electrical heaters or heating elements.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1A:
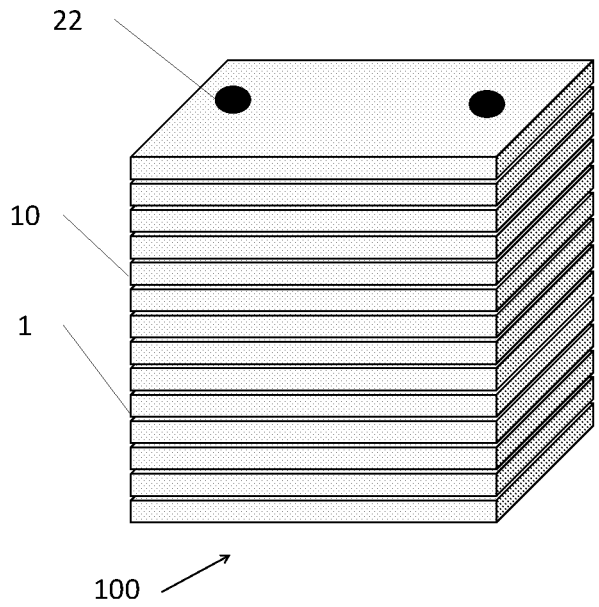
FIG. 1A is a perspective view of a solid oxide electrolyzer cell (SOEC) stack.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention. It will also be understood that the term "about" may refer to a minor measurement errors of, for example, 5 to 10%. In addition, weight percentages (wt %) and atomic percentages (at %) as used herein respectively refer to a percent of total weight or a percent of a total number of atoms of a corresponding composition.

Words such as "thereafter," "then," "next," etc. are not necessarily intended to limit the order of the steps; these words may be used to guide the reader through the description of the methods. Further, any reference to claim elements in the singular, for example, using the articles "a," "an" or "the" is not to be construed as limiting the element to the singular.

The term "electrolyzer cell stack," as used herein, means a plurality of stacked electrolyzer cells that can optionally share a common water inlet and exhaust passages or risers. The "electrolyzer cell stack," as used herein, includes a distinct electrical entity which contains two end plates which are connected directly to power conditioning equipment and the power (i.e., electricity) input of the stack or comprises a portion of an electrolyzer cell column that contains terminal plates which provide electrical input. Herein, a "solid oxide cell" may refer to a solid oxide electrolyzer cell and/or a solid oxide fuel cell.

Figure 1B:
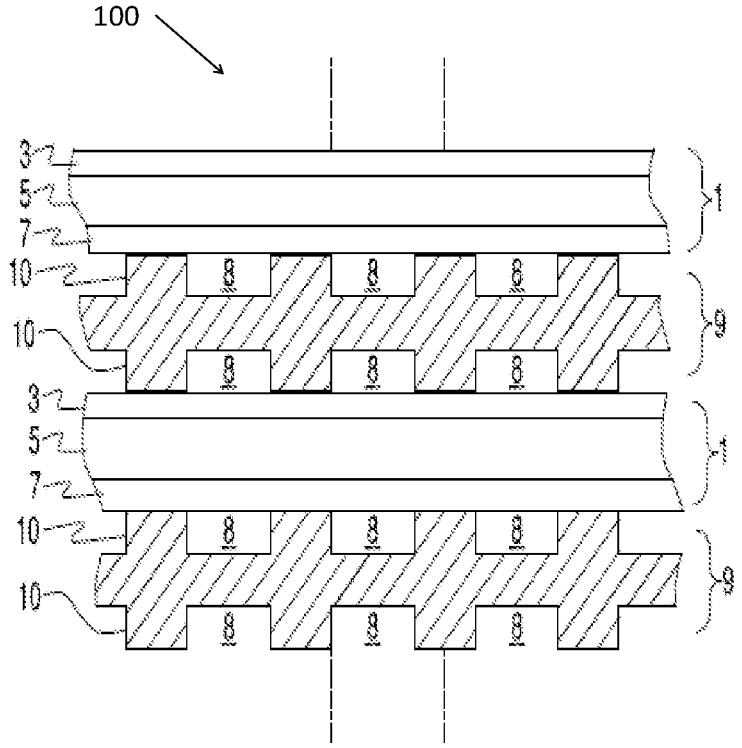
FIG. 1B is a side cross-sectional view of a portion of the stack of FIG. 1A.

FIG. 1A is a perspective view of a solid oxide cell stack 100, and FIG. 1B is a side cross-sectional view of a portion of the stack 100 of FIG. 1A. Referring to FIGS. 1A and 1B, the stack 100 includes multiple solid cells 1 that may be solid oxide fuel cells or solid oxide electrolyzer cells. The solid oxide cells 1 are separated by interconnects 10, which may also be referred to as gas flow separator plates or bipolar plates. Each solid oxide cell 1 includes an air electrode 3, a solid oxide electrolyte 5, and a fuel electrode 7. The stack 100 also includes internal fuel riser channels 22.

Each interconnect 10 electrically connects adjacent solid oxide cells 1 in the stack 100. In particular, an interconnect 10 may electrically connect the fuel electrode 7 of one solid oxide cell 1 to the air electrode 3 of an adjacent solid oxide cell 1. FIG. 1B shows that the lower solid oxide cell 1 is located between two interconnects 10.

Each interconnect 10 includes ribs that at least partially define fuel channels 8 (collectively, layer 9). The interconnect 10 may operate as a gas-fuel separator that separates a fuel, such as a hydrocarbon fuel, flowing to the fuel electrode 7 of one solid oxide cell 1 in the stack 100 from oxidant, such as air, flowing to the air electrode 3 of an adjacent solid oxide cell 1 in the stack 100. At either end of the stack 100, there may be an air end plate or fuel end plate (not shown) for providing air or fuel, respectively, to the end electrode.

Figure 2A:
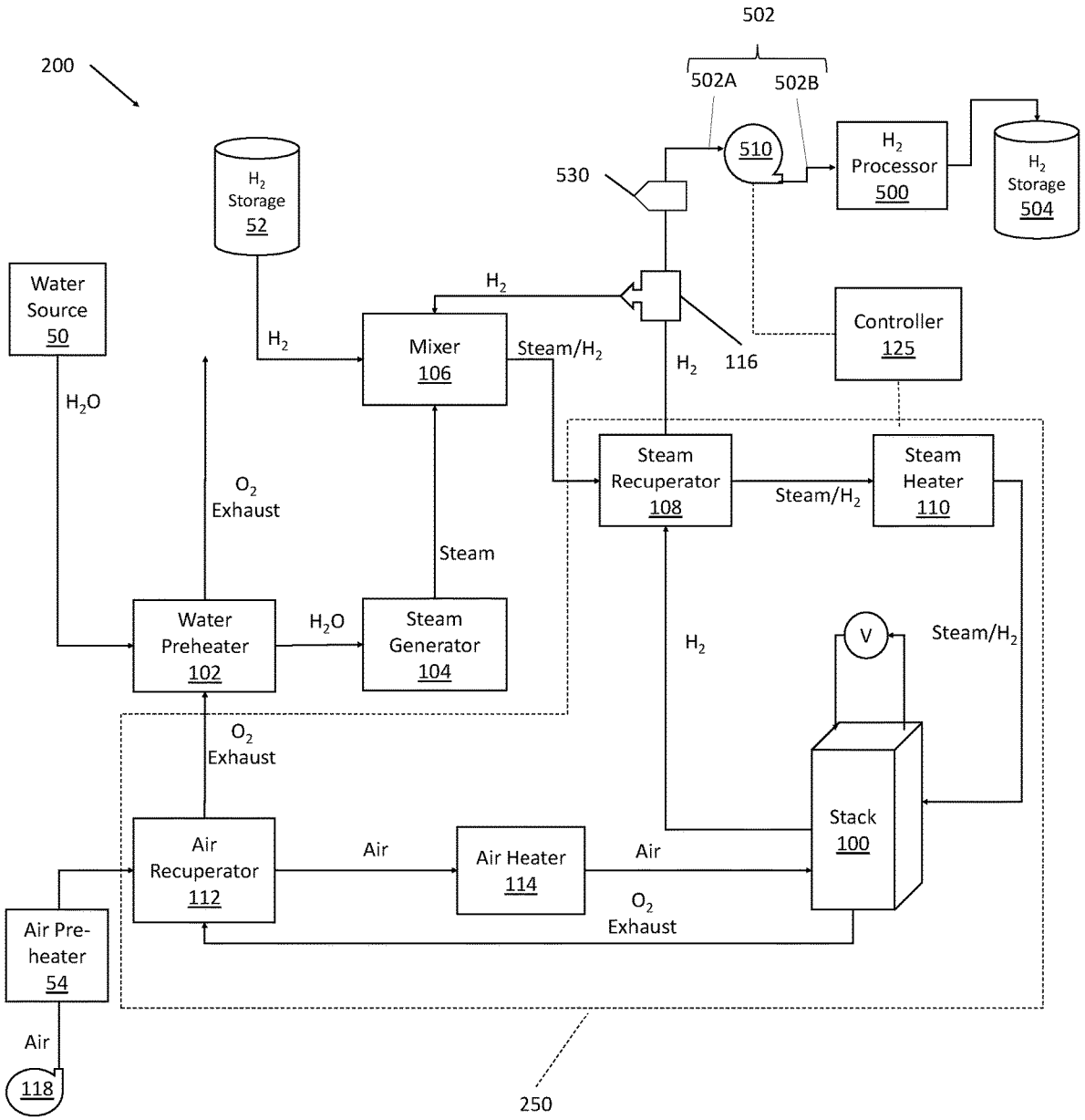
FIGS. 2A and 2B are schematic views of process flow diagrams showing process flows through an electrolyzer system according to various embodiments of the present invention.
Figure 2B:
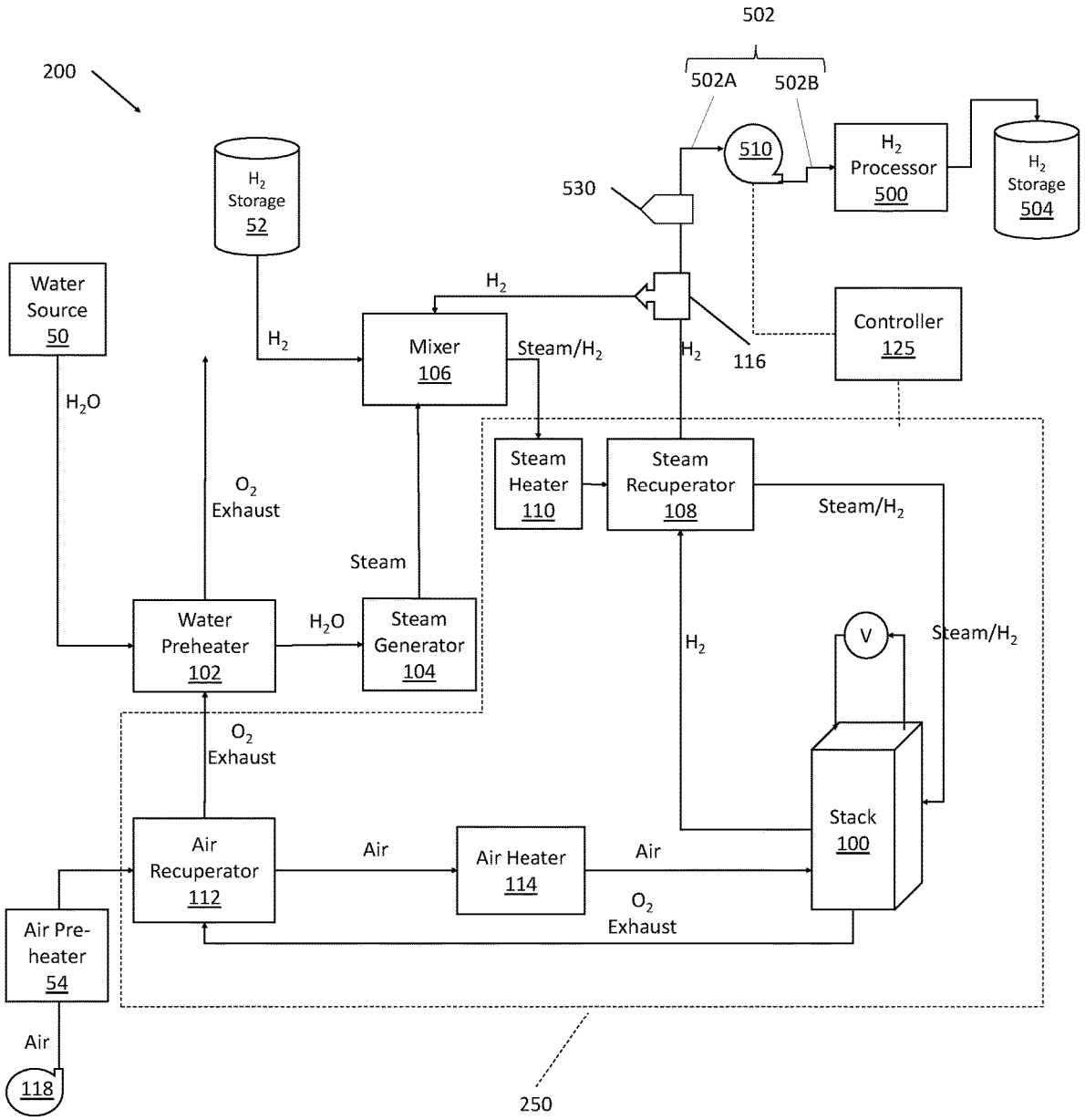

FIGS. 2A and 2B are schematic views showing a process flows in an electrolyzer system 200, according to various embodiments of the present invention. Referring to FIGS. 1A, 1B, 2A and 2B, the system 200 may include an electrolyzer cell (SOEC) stack 100 including multiple solid oxide electrolyzer cells (SOECs), which may be configured as described with respect to FIGS. 1A and 1B. The system 200 may also include a steam generator 104, a steam recuperator 108, a steam heater 110, an air recuperator 112, and an air heater 114. The system 200 may also include an optional water preheater 102 and an optional mixer 106.

The system 200 may include a hotbox 250 to house various components, such as the stack 100, steam recuperator 108, steam heater 110, air recuperator 112, and/or air heater 114. In some embodiments, the hotbox 250 may include multiple stacks 100. The water preheater 102 and the steam generator 104 may be located external to the hotbox 250 as shown in FIGS. 2A and 2B. Alternatively, the water preheater 102 and/or the steam generator 104 may be located inside the hotbox 250.

During operation, the stack 100 may be provided with steam and electric current or voltage from an external power source. In particular, the steam may be provided to the fuel electrodes 7 of the electrolyzer cells 1 of the stack 100, and the power source may apply a voltage between the fuel electrodes 7 and the air electrodes 3, in order to electrochemically split water molecules and generate hydrogen (e.g., $H_2$) and oxygen (e.g., $O_2$). Air may also be provided to the air electrodes 3, in order to sweep the oxygen from the air electrodes 3. As such, the stack 100 may output a hydrogen stream and an oxygen-rich exhaust stream, such as an oxygen-rich air stream ("oxygen exhaust stream").

In order to generate the steam, water may be provided to the system 200 from a water source 50. The water may be deionized (DI) water that is deionized as much as is practical (e.g., <0.1 μuS/cm), in order to prevent and/or minimize scaling during vaporization. In some embodiments, the water source 50 may include deionization beds. In various embodiments, the system 200 may include a water flow control device (not shown) such as a mass flow controller, a positive displacement pump, a control valve/water flow meter, or the like, in order to provide a desired water flow rate to the system 200.

If the system 200 includes the water preheater 102, the water may be provided from the water source 50 to the water preheater 102. The water preheater 102 may be a heat exchanger configured to heat the water using heat recovered from the oxygen exhaust stream. Preheating the water may reduce the total power consumption of the system 200 per unit of hydrogen generated. In particular, the water preheater 102 may recover heat from the oxygen exhaust stream that may not be recoverable by the air recuperator 112, as discussed below. The oxygen exhaust stream may be output from the water preheater 102 at a temperature above 80° C., such as above 100° C., such as a temperature of about 110° C. to 120° C.

The water output from the water preheater 102 or the water source 50 may be provided to the steam generator 104. A portion of the water may vaporize in the water preheater. The steam generator 104 may be configured to heat the water not vaporized in the water preheater to convert the water into steam. For example, the steam generator 104 may include a heating element to vaporize the water and generate steam. For example, the steam generator 104 may include an AC or DC resistance heating element, or an induction heating element.

The steam generator 104 may include multiple zones/elements that may or may not be mechanically separate. For example, the steam generator 104 may include a pre-boiler to heat the water up to, or near to the boiling point. The steam generator 104 may also include a vaporizer configured to convert the pre-boiled water into steam. The steam generator 104 may also include a deaerator to provide a relatively small purge of steam to remove dissolved air from the water prior to bulk vaporization. The steam generator 104 may also include an optional superheater configured to further increase the temperature of the steam generated in the vaporizer. The steam generator 104 may include a demister pad located downstream of the heating element and/or upstream from the super heater. The demister pad may be configured to minimize entrainment of liquid water in the steam output from the steam generator 104 and/or provided to the superheater.

If the steam product is superheated, it will be less likely to condense downstream from the steam generator 104 due to heat loss to ambient conditions. Avoidance of condensation is preferable, as condensed water is more likely to form slugs of water that may cause significant variation of the delivered mass flow rate with respect to time. It may also be beneficial to avoid excess superheating, in order to limit the total power consumption of the system 200. For example, the steam may be superheated by an amount ranging from about 10° C. to about 100° C.

Blowdown from the steam generator 104 may be beneficial for long term operation, as the water will likely contain some amount of mineralization after deionization. Typical liquid blowdown may be on the order of 1%. The blowdown may be continuous, or may be intermittent, e.g. 10× the steady state flow for 6 seconds out of every minute, 5× the steady state flow for 1 minute out of every 5 minutes, etc. The need for a water discharge stream can be eliminated by pumping the blowdown into the hot oxygen exhaust.

The steam output from the steam generator 104 may be provided to the steam recuperator 108. However, if the system 200 includes the optional mixer 106, the steam may be provided to the mixer 106 prior to being provided to the steam recuperator 108. In particular, the steam may include small amounts of dissolved air and/or oxygen. As such, the mixer 106 may be configured to mix the steam with hydrogen gas, in order to maintain a reducing environment in the stack 100, and in particular, at the fuel electrodes 7.

The mixer 106 may be configured to mix the steam with hydrogen received from a hydrogen storage device 52 and/or with a portion of the hydrogen stream output from the stack 100. The hydrogen addition rate may be set to provide an amount of hydrogen that exceeds an amount of hydrogen needed to react with an amount of oxygen dissolved in the steam. The hydrogen addition rate may either be fixed or set to a constant water to hydrogen ratio. However, if the steam is formed using water that is fully deaerated, the mixer 106 and/or hydrogen addition may optionally be omitted.

In some embodiments, the hydrogen may be provided by the external hydrogen source during system startup and/or during steady-state operations. For example, during startup, the hydrogen may be provided from the hydrogen storage device, and during steady-state, the hydrogen may be provided from the hydrogen storage device 52 and/or by diverting a portion of the hydrogen stream (i.e., hydrogen exhaust stream) generated by the stack 100 to the mixer 106. In particular, the system 200 may include a hydrogen diverter 116, such as a splitter, pump, blower and/or valve, configured to selectively divert a portion of the generated hydrogen stream to the mixer 106, during steady-state operation.

The steam recuperator 108 may be a heat exchanger configured to recover heat from the hydrogen stream output from the stack 100. As such, the steam recuperator 108 may be configured to increase the efficiency of the system 200. The steam may be heated to at least 700° C., such as 720° C. to 780° C. in the steam recuperator 108.

The steam output from the steam recuperator 108 may be provided to the steam heater 110 which is located downstream from the steam recuperator 108, as shown in FIG. 2A. The steam heater 110 may include a heating element, such as a resistive or inductive heating element. The steam heater 110 may be configured to heat the steam to a temperature above the operating temperature of the stack 100. For example, depending on the health of the stack 100, the water utilization rate of the stack 100, and the air flow rate to the stack 100, the steam heater 110 may heat the steam to a temperature ranging from about 900° C. to about 1200° C., such as 920° C. to 980° C. Accordingly, the stack 100 may be provided with steam or a steam-hydrogen mixture at a temperature that allows for efficient hydrogen generation. Heat may also be transported directly from the steam heater to the stack by radiation (i.e., by radiant heat transfer).

In one alterative embodiment shown in FIG. 2B, the steam recuperator 108 may be located downstream from the steam heater 110 such that steam existing the steam heater 110 enters the steam recuperator 108 instead of vice-versa. In another alternate embodiment, the steam heater 110 may include a heat exchanger configured to heat the steam using heat extracted from a high-temperature fluid, such as a fluid heated to about 1200° C. or more. This fluid may be provided from a solar concentrator farm or a power plant, such as a nuclear reactor power plant, for example. Alternatively, if the fluid is a high temperature steam, such as steam provided from a nuclear reactor power plant, then such steam may be provided to the fuel electrodes 7 of the stack 100. In this case, the water source 50 may comprise a source of high temperature steam, and one or more of the water preheater 102, steam generator 104, steam recuperator 108 and/or steam heater 110 may be omitted.

In some embodiments, the steam heater 110 may include multiple steam heater zones with independent power levels (divided vertically or circumferentially or both), in order to enhance thermal uniformity, in some embodiments.

In some embodiments, the operations of the steam recuperator 108 and the steam heater 110 may be combined into a single component. For example, the steam recuperator 108 may include a voltage source configured to apply a voltage to heat exchange fins of the steam recuperator 108, such that the heat exchange fins operate as resistive heating elements and heat the steam to a temperature high enough to be provided to the stack 100, such as a temperature ranging from about 900° C. to about 1200° C. The high temperature steam (or optionally a steam/hydrogen mixture) output from the steam heater 110 may be provided to the fuel electrodes 7 of the stack 100.

The oxygen exhaust output from the stack 100 may be provided to the air recuperator 112. The air recuperator 112 may be provided with ambient air by an air blower 118. The air recuperator 112 may be configured to heat the air using heat extracted from the oxygen exhaust. In some embodiments, the ambient air may be filtered to remove contaminants, prior to being provided to the air recuperator 112 or the air blower 118.

Air output from the air recuperator 112 may be provided to the air heater 114. The air heater may include a resistive or inductive heating element configured to heat the air to a temperature exceeding the operating temperature of the stack 100. For example, depending on the health of the stack 100, the water utilization rate of the stack 100, and the air flow rate to the stack 100, the air heater 114 may heat the air to a temperature ranging from about 900° C. to about 1200° C., such as 920° C. to 980° C. Accordingly, the stack 100 may be provided with air at a temperature that allows for efficient hydrogen generation. Heat may also be transported directly from the air heater to the stack by radiation.

The higher the temperature output from the air recuperator, the less power is required for the air heater 114. Increased pressure drop on either side of the air recuperator 112 may be counteracted with increased air blower 118 power. Increased pressure drop may aid the circumferential mass flow uniformity, creating a more uniform heat transfer environment, and higher temperature for the air inlet stream output from the air recuperator 112.

In alternative embodiments, the air heater 114 may include a heat exchanger configured to heat the air using heat extracted from a high-temperature fluid, such as a fluid heated to about 1200° C., or more. This fluid may be provided from a solar concentrator farm or a nuclear reactor, for example.

The air heater 114 may include multiple air heater zones with independent power levels (divided vertically or circumferentially or both), in order to enhance thermal uniformity, in some embodiments. In some embodiments, the air heater 114 may be disposed below the air recuperator 112, or between the stack 100 and the steam recuperator 108. The air heater 114 may include baffles having slits of different sizes at different heights along the baffles, to allow air to exit the air heater 114 approximately evenly in both temperature and height, at all heights along the air heater 114. Air from the air heater 114 is provided to the air electrodes 3 of the stack 100.

In some embodiments, the air recuperator 112 and the air heater 114 may be combined into a single component. For example, the air recuperator 112 may include a voltage source configured to apply a voltage to heat exchange fins of a heat exchanger included in the air recuperator 112 combined component, such that the fins operate as resistive heating elements and heat the air to a temperature high enough to be provided to the stack 100, such as a temperature ranging from about 900° C. to about 1200° C.

According to various embodiments, the system 200 may include an optional air preheater 54 disposed outside of the hotbox 250. In particular, the air preheater 54 may be configured to preheat air provided to the hotbox 250 by the air blower 118. In some embodiments, the air preheater 54 may operate using electricity. In other embodiments, the air preheater 54 may operate using a hydrocarbon fuel, such as natural gas or the like. For example, if the system 200 is provided with power from a power source that is intermittent or provides an insufficient amount of power to operate an electric heater, such solar or wind power generation systems, the air preheater 54 may utilize a hydrocarbon power source (e.g., a gas heater). Alternatively, the air preheater 54 may be omitted.

Because the air preheater 54 is located outside of the hotbox 250, the air preheater 54 may be advantageously serviced without the need to access the inside of the hotbox 250 and/or interrupt the operation of the stack 100 and/or other components located inside of the hotbox 250. In some embodiments, the air preheater 54 may allow for the air heater 114 to be omitted if the air preheater 54 heats the air above stack temperature. However, in other embodiments, the system 200 may include both the air preheater 54 and the air heater 114.

During system startup, the air preheater 54 may be configured to heat air provided to the hotbox to a temperature sufficient to increase the internal temperature of the hotbox 250 and/or the temperature of the stack 100 up to a temperature approaching the operating temperature thereof. Preheated air provided to the air recuperator 112 may also operate to preheat stack exhaust provided through the air recuperator 112 to the water preheater 102 during system startup. Since the stack oxygen exhaust may be initially output at a relatively low temperature, the air preheater 54 may be used to indirectly preheat the water provided from the water source 50 to the hotbox 250.

During steady-state operation, the air preheater 54 may also be configured heat air to a temperature sufficient to maintain the hotbox 250 at steady-state operating temperature, such as 750 to 950° C. For example, the heat output of the air preheater 54 may be lower during steady-state operation than during system startup.

In some embodiments, the system 200 may be operated in a thermal neutral configuration, where each electrolyzer cell 1 in the stack 100 is provided with a thermal-neutral voltage. In particular, the current provided to each electrolyzer cell 1 may be varied such that the heat generated by $I^2R$ heating balances the (endothermic) heat of reaction. As such, use of the steam heater 110 and/or the air heater 114 may be minimized or eliminated during steady-state thermal neutral operation.

A hydrogen stream (i.e., hydrogen exhaust stream) from the stack 100 may be a warm stream containing hydrogen gas and water. The hydrogen stream may be output from the steam recuperator 108 at a temperature of 120° C. to 150° C. The steam recuperator 108 may be fluidly connected to a hydrogen processor 500 by an output conduit 502. In some embodiments, the hydrogen processor 500 may be connected to, a hydrogen storage device or tank 504.

The hydrogen processor 500 may include a hydrogen pump, a condenser, or a combination thereof. The hydrogen pump may be an electrochemical hydrogen pump and/or may be configured to operate at a high temperature. For example, the hydrogen pump may be configured to operate at a temperature of from about 120° C. to about 150° C., in order to remove from about 70% to about 90% of the hydrogen from the hydrogen stream. The compressor may be a liquid ring compressor or a diaphragm compressor, for example. In some embodiments, the condenser may be an air-cooled or water-enhanced, air-cooled condenser and/or heat exchanger configured to cool a hydrogen stream to a temperature sufficient to condense water vapor in the hydrogen stream. For example, the hydrogen processor 500 may be configured to compress the hydrogen stream to a desired pressure, such as about 2500 to about 8000 psig. Compression may include multiple stages, with inter-stage cooling, and water removal.

In various embodiments, the hydrogen processor 500 may include a series of electrochemical hydrogen pumps, which may be disposed in series and/or in parallel with respect to a flow direction of the hydrogen stream, in order to compress the hydrogen stream. The final product from compression may still contain traces of water. As such, the hydrogen processor 500 may include a dewatering device, such as a temperature swing adsorption reactor or a pressure swing adsorption reactor, to remove this residual water, if necessary. The final product may be high pressure (e.g., about 2500 to about 8000 psig) purified, hydrogen. The product may also contain some nitrogen gas, which may be dissolved air in the water. The nitrogen may be removed automatically during electrochemical compression.

A remaining un-pumped effluent from the hydrogen processor 500 may be a water rich stream that is fully vaporized. This water rich stream may be fed to a blower for recycle into the mixer 106 or stream recuperator 108, eliminating the need for water vaporization in the steam generator 104. The system may be configured to repurify (e.g., in DI beds) the residual water and provide the residual water removed from the compressed hydrogen stream to the water preheater. Electrochemical compression may be more electrically efficient than traditional compression.

The hydrogen streams of multiple stacks 100 on site may be combined into a single stream. This combined stream may be cooled as much as practical using, for example, air coolers or heat exchangers cooled by a site cooling water tower, which may be part of the hydrogen processor 500. The hydrogen output from the hydrogen processor 500 may be provided to the hydrogen tank 504 for storage or use, such as to be used as a fuel in a fuel cell power generation system.

Steam loss into the hydrogen stream may be minimized by increasing the hydrogen pump pressure to a pressure ranging from about 20-50 psig, for example. This separation may be at the electrolyzer module level, system level, stamp level, or site level.

Water condensation and compression of the hydrogen stream may consume a significant amount of power. In some embodiments, air flow to the stack 100 may be reduced or stopped, such that the stack 100 outputs pure or nearly pure oxygen gas as stack exhaust. In addition, the air and fuel sides of the electrolyzer cells 1 may be operated at an equal pressure ranging from about 20 psig to about 50 psig. In some embodiments, air provided to the stack 100 may be provided at a pressure of about 100 slm or less.

High pressure operation may allow for the elimination of the power and equipment associated with the first stage of the hydrogen stream compression, may reduce the size of the initial condenser stage, due to the higher dew point due to the higher pressure, and/or may reduce the physical space required for flow channels, due to the higher density associated with higher pressure.

As noted above, the system 200 may be configured to operate with a variety of different hydrogen processors 500, which may be provided on site by a third party. As such, it may be difficult to match the flow and/or production rate of the hydrogen stream output from the system 200 with the throughput of a particular hydrogen processor 500. In particular, such variations may induce positive and/or negative pressure fluctuations within the output conduit 502. For example, if the throughput of the hydrogen processor 500 is too high (e.g., the hydrogen processor 500 pulls too hard on the hydrogen stream) a negative pressure may be induced within the system 200, or if the throughput is too low, a positive pressure may be induced within the system 200.

Such pressure fluctuations may cause problems within the system 200. For example, excessive negative pressures may result in air leaking into the system 200, or may result in a high pressure variation across the electrolytes of the stack 100, which may increase the risk of electrolyte damage, such as cracking. Excessively high pressures may also result in pressure variations across the electrolytes and increase the risk of electrolyte damage.

Accordingly, the system may include a first output conduit 502A, a second output conduit 502B, and a hydrogen blower 510. The first output conduit 502A may fluidly connect the fuel cell stack 100 and an inlet of the hydrogen blower 510. The second output conduit 502B may fluidly connect an outlet of the hydrogen blower 510 to the hydrogen processor 500. The hydrogen blower 510 may be configured to increase the pressure of the hydrogen stream output from the hotbox 250. For example, the hydrogen blower 510 may be configured to increase the pressure of a hydrogen stream by from about 2 to about 15 pounds per square in gauge (psig), such as from about 5 to about 10 psig. The hydrogen blower 510 may also operate to isolate the components of the hotbox 250, such as the stack 100, from pressure fluctuations induced by the operation of the hydrogen processor 500.

In some embodiments, the hydrogen blower 510 may be configured to receive a hydrogen stream generated by a single electrolyzer system 250 or stack 100, as shown in FIG. 2A. In other embodiments, the hydrogen blower 510 may be configured to receive hydrogen streams generated by multiple electrolyzer systems 250 and/or by multiple stacks 100.

In various embodiments, the system 200 may include an optional water knockout device 530 configured to remove condensed water from the hydrogen stream, in order to reduce and/or prevent liquid water accumulation in the hydrogen blower 510.

In some embodiments, the hydrogen diverter 116 may be used to divert the hydrogen stream, such that hydrogen may be fed to displace most or all of the steam in the system 200. The hydrogen diverter 116 may then closed to maintain a reducing atmosphere in the stack 100, without any additional hydrogen consumption. Air flow to the stack 100 may be significantly reduced or eliminated. In some embodiments, there may be a minimum air flow to keep the air heater 114 from overheating.

In some embodiments, condensed water may be recycled to the feed of the process (feed to the DI beds) in the water source 50. Hydrogen added to the steam in the mixer 106 may be produced during the first stage or any intermediate stage of the compression train, and may be dehumidified if necessary. The hydrogen storage device 52 may include a low/intermediate pressure storage tank for the hydrogen provided through the mixer 106 to the stack 100.

According to various embodiments, the system 200 may include a controller 125, such as a central processing unit, that is configured to control the operation of the system 200. For example, the controller 125 may be wired or wirelessly connected to various elements of the system 200 to control the same.

In some embodiments, the controller 125 may be configured to control the speed of the hydrogen blower 510 based on a flow rate of the hydrogen stream and/or an inlet pressure generated by the hydrogen processor 500.

In some embodiments, the controller 125 may be configured to control the system 200, such that the system 200 may be operated in a standby mode where no hydrogen stream is generated. During the standby mode, electrical heaters associated with (i.e., located in a heat transfer relationship with) the stack 100 may be run at the minimum power level needed to keep the electrolyzer cells 1 at a desired standby temperature. The desired standby temperature may be different from the desired production operating temperature, and may be impacted by an acceptable time needed to return to a desired operating temperature.

Recovery from standby mode to steady-state operation may allow for hydrogen generation to be initiated at a lower temperature than the standard steady-state operating temperature. At the lower temperature, cell resistance may be higher, which may provide additional heating to increase the stack 100 to the steady-state operating temperature. Water/steam feed can be significantly reduced or eliminated. Hydrogen addition to the steam in the mixer 106 may also be significantly reduced or eliminated.

According to various embodiments, the controller 125 may be configured to control the operation of the system 200 based on various site-wide control parameters. For example, the controller 125 may be configured to control hydrogen production based on any of: the operational limits of each SOEC stack; power availability; instantaneous average power costs, including the impact of demand charges at all tiers; instantaneous marginal power costs, including the impact of demand charges at all tiers; instantaneous power renewable content; available hydrogen storage capacity; stored energy available for use (e.g., either thermal storage or electrical storage); a hydrogen production plan (e.g., a daily, weekly, or month plan, etc.); hydrogen production revenue implications (e.g., sales price, adjustments for production levels, penalties for nonperformance, etc.); a maintenance plan; the relative health of all hotboxes on site; the compression/condensation train mechanical status; the water/steam/hydrogen feed availability; the weather conditions and/or forecast; any other known external constraints, either instantaneous, or over some production plan period (e.g., only allowed so much water per month, or so many MW-hr per month); and/or the minimum acceptable time to start producing hydrogen from standby mode (if standby is predicted to last multiple hours, it may be desirable to allow the cells to cool below operating temperature).

Figure 3:
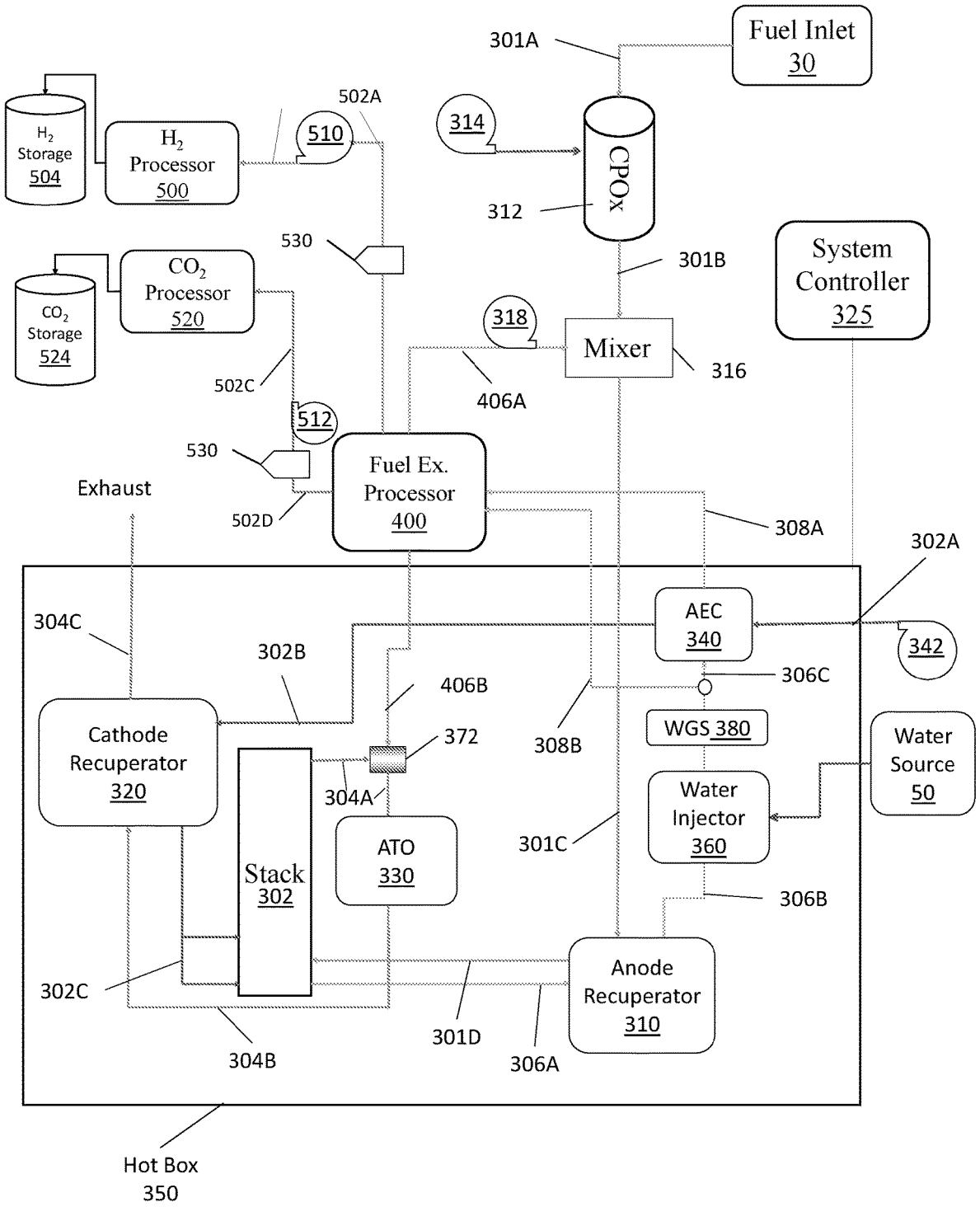
FIG. 3 is a schematic representation of a solid oxide fuel cell (SOFC) system, according to various embodiments of the present invention.

FIG. 3 is a schematic representation of a solid oxide fuel cell (SOFC) system 300, according to various embodiments of the present invention. Referring to FIG. 3, the system 300 includes a hotbox 350 and various components disposed therein or adjacent thereto. The hotbox 350 may contain at least one fuel cell stack 302, such as a solid oxide fuel cell stack containing alternating fuel cells and interconnects. One solid oxide fuel cell of the stack contains a ceramic electrolyte, such as yttria stabilized zirconia (YSZ), scandia stabilized zirconia (SSZ), scandia and ceria stabilized zirconia or scandia, yttria and ceria stabilized zirconia, an anode electrode, such as a nickel-YSZ, a nickel-SSZ or nickel-doped ceria cermet, and a cathode electrode, such as lanthanum strontium manganite (LSM). The interconnects may be metal alloy interconnects, such as chromium-iron alloy interconnects. The stacks 302 may be arranged over each other in a plurality of columns.

The hotbox 350 may also contain an anode recuperator 310, a cathode recuperator 320, an anode tail gas oxidizer (ATO) 330, an anode exhaust cooler 340, a vortex generator 372, and a water injector 360. The system 300 may also include a catalytic partial oxidation (CPOx) reactor 312, a mixer 316, a CPOx blower 314 (e.g., air blower), a main air blower 342 (e.g., system blower), and an anode recycle blower 318, which may be disposed outside of the hotbox 350. However, the present disclosure is not limited to any particular location for each of the components with respect to the hotbox 350.

The CPOx reactor 312 receives a fuel inlet stream from a fuel inlet 30, through a fuel conduit 301A. The fuel inlet 30 may be a fuel tank or a utility natural gas line including a valve to control an amount of fuel provided to the CPOx reactor 312. The CPOx blower 314 may provide air to the CPOx reactor 202 during system start-up. The fuel and/or air may be provided to the mixer 316 by a fuel conduit 301B. Fuel flows from the mixer 316 to the anode recuperator 310 through a fuel conduit 301C. The fuel is heated in the anode recuperator 310 by a portion of the fuel exhaust and the fuel then flows from the anode recuperator 310 to the stack 302 through a fuel conduit 301D.

The main air blower 342 may be configured to provide an air stream (e.g., air inlet stream) to the anode exhaust cooler 340 through air conduit 302A. Air flows from the anode exhaust cooler 340 to the cathode recuperator 320 through air conduit 302B. The air is heated by the ATO exhaust in the cathode recuperator 320. The air flows from the cathode recuperator 320 to the stack 302 through air conduit 302C.

Anode exhaust (e.g., fuel exhaust) generated in the stack 302 is provided to the anode recuperator 310 through anode exhaust conduit 306A. The anode exhaust may contain unreacted fuel and may also be referred to herein as fuel exhaust. The anode exhaust may be provided from the anode recuperator 310 to a shift reactor 380, such as a water gas shift (WGS) reactor, by anode exhaust conduit 306B. A water injector 360 may be fluidly connected to the anode exhaust conduit 306B. The anode exhaust may be provided from the shift reactor 380 to the anode exhaust cooler 340 by anode exhaust conduit 306C. The anode exhaust heats the air inlet stream in the anode exhaust cooler 340 and may then be provided from the anode exhaust cooler 340 to the fuel exhaust processor 400.

In particular, the anode exhaust may be output from the anode exhaust cooler 340 to the fuel exhaust processor 400 by a first recycling conduit 308A. In some embodiments, anode exhaust may be provided to the fuel exhaust processor 400 by an optional second recycling conduit 308B. In particular, the second recycling conduit 308B may be configured to provide hotter anode exhaust to the fuel exhaust processor 400 than the first recycling conduit 308A, since anode exhaust is cooled in the anode exhaust cooler 340 prior to entering the first recycling conduit 308A.

The shift reactor 380 may be any suitable device that converts components of the fuel exhaust into free hydrogen ($H_2$) and/or water. For example, the shift reactor 380 may comprise a tube or conduit containing a catalyst that converts carbon monoxide (CO) and water vapor in the fuel exhaust stream into carbon dioxide and hydrogen, via the water gas shift reaction ($CO+H_2O \leftrightarrow CO_2+H^2$). Thus, the shift reactor 380 increases the amount of hydrogen and carbon dioxide in the anode exhaust and decreases the amount of carbon monoxide in the anode exhaust. For example, the shift reactor 380 may reduce the amount of carbon monoxide in the anode exhaust to about 5% by volume or less, such as about 4% or less, or about 3% or less. The catalyst may be any suitable catalyst, such as an iron oxide or a chromium-promoted iron oxide catalyst.

Cathode exhaust generated in the stack 302 flows to the ATO 330 through cathode exhaust conduit 304A. The vortex generator 372 may be disposed in the cathode exhaust conduit 304A and may be configured to swirl the cathode exhaust. The swirled cathode exhaust may mix with hydrogen output from the fuel exhaust processor 400 before being provided to the ATO 330. The mixture may be oxidized in the ATO 330 to generate ATO exhaust. The ATO exhaust flows from the ATO 330 to the cathode recuperator 320 through the cathode exhaust conduit 304B. Exhaust flows from the cathode recuperator 320 and out of the hotbox 350 through cathode exhaust conduit 304C.

Water flows from a water source 50, such as a water tank or a water pipe, to the water injector 360 through a water conduit. The water injector 360 injects water directly into first portion of the anode exhaust provided in the anode exhaust conduit 306C. Heat from the first portion of the anode exhaust (also referred to as a recycled anode exhaust stream) provided in the exhaust conduit 306C vaporizes the water to generate steam. The steam mixes with the anode exhaust, and the resultant mixture is provided to the anode exhaust cooler 340. The mixture is then routed through the fuel exhaust processor 400 and provided to the mixer 316. The mixer 316 is configured to mix the steam and first portion of the anode exhaust with fresh fuel (i.e., fuel inlet stream). This humidified fuel mixture may then be heated in the anode recuperator 310 by the anode exhaust, before being provided to the stack 302. The system 300 may also include one or more fuel reforming catalysts located inside and/or downstream of the anode recuperator 310. The reforming catalyst(s) reform the humidified fuel mixture before it is provided to the stack 302.

The system 300 may further a system controller 325 configured to control various elements of the system 300. The system controller 325 may include a central processing unit configured to execute stored instructions. For example, the system controller 325 may be configured to control fuel and/or air flow through the system 300, according to fuel composition data.

Figure 4B:
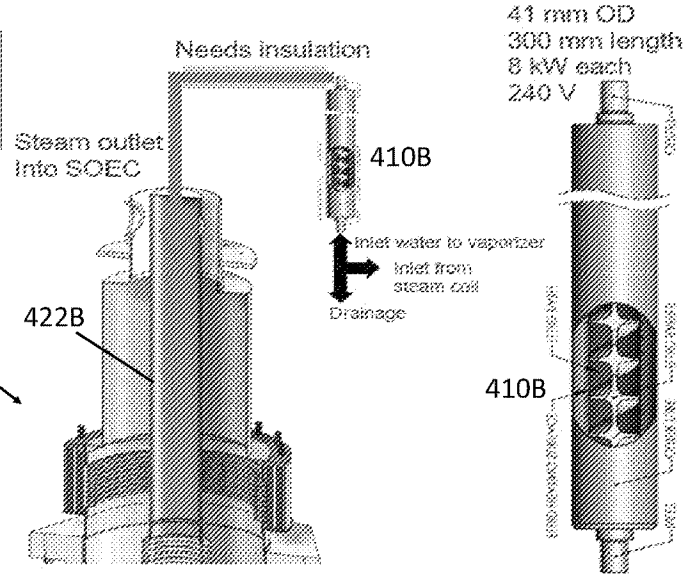
FIGS. 4A and 4B illustrate a vaporizer according to various embodiments of the present invention.
Figure 4A:
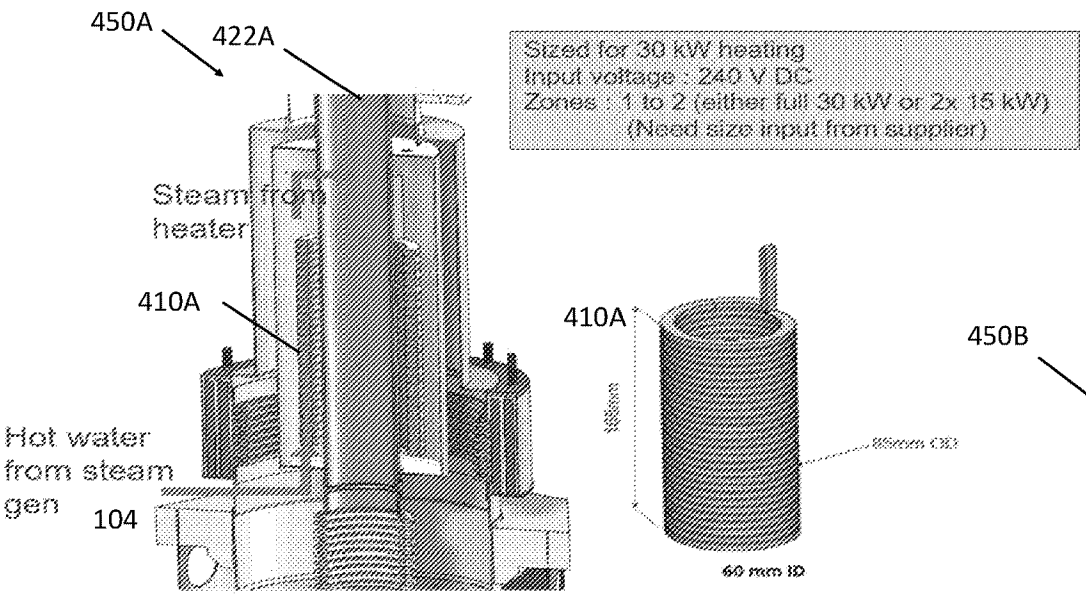

FIGS. 4A and 4B illustrate a vaporizer according to various embodiments of the present invention. A vaporizer is a heating element device for converting water or another liquid into a vapor. For example, steam generator 104, as described in connection with FIGS. 2A and 2B, is a vaporizer. Although a coil and an immersive coil type device are illustrated, other heating element types may be used including metallic, ceramic, and polymer. In the electrolyzer fuel cell system, vaporizer 410A, 410B (e.g., receiving as inlet from steam generator 104) feeds steam to water conduit 422A, 422B of hotbox 450A, 450B, respectively (e.g., also hotbox 250) by vaporizing liquid water as inlet.

As illustrated in FIG. 4A, vaporizer 410A can be internal to hotbox 450A. Alternatively, as illustrated in FIG. 4B, vaporizer 410B can be external to hotbox 450B. In some embodiments, multiple vaporizers can be used, including a combination of both internal and external integration to the hotbox. In some embodiments, multiple vaporizers can be used including combinations of steam generators (e.g., steam generator 104) and vaporizers 410A and/or 410B.

Figures 5A, 5B:
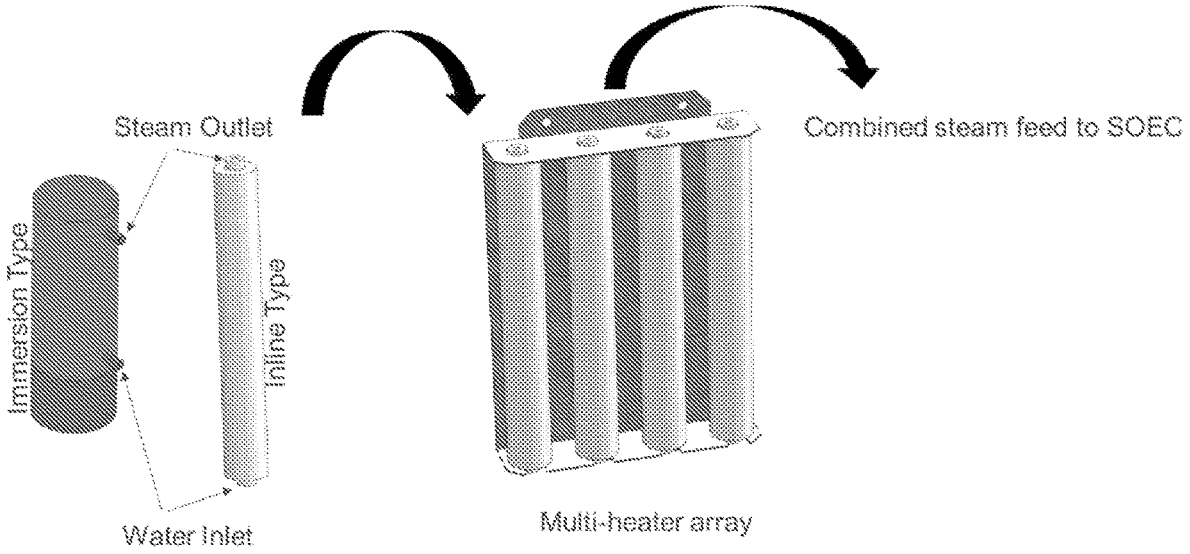
FIG. 5A illustrates a single vaporizer.
FIG. 5B illustrates a multi-vaporizer array according to various embodiments of the present invention.
Figure 6:
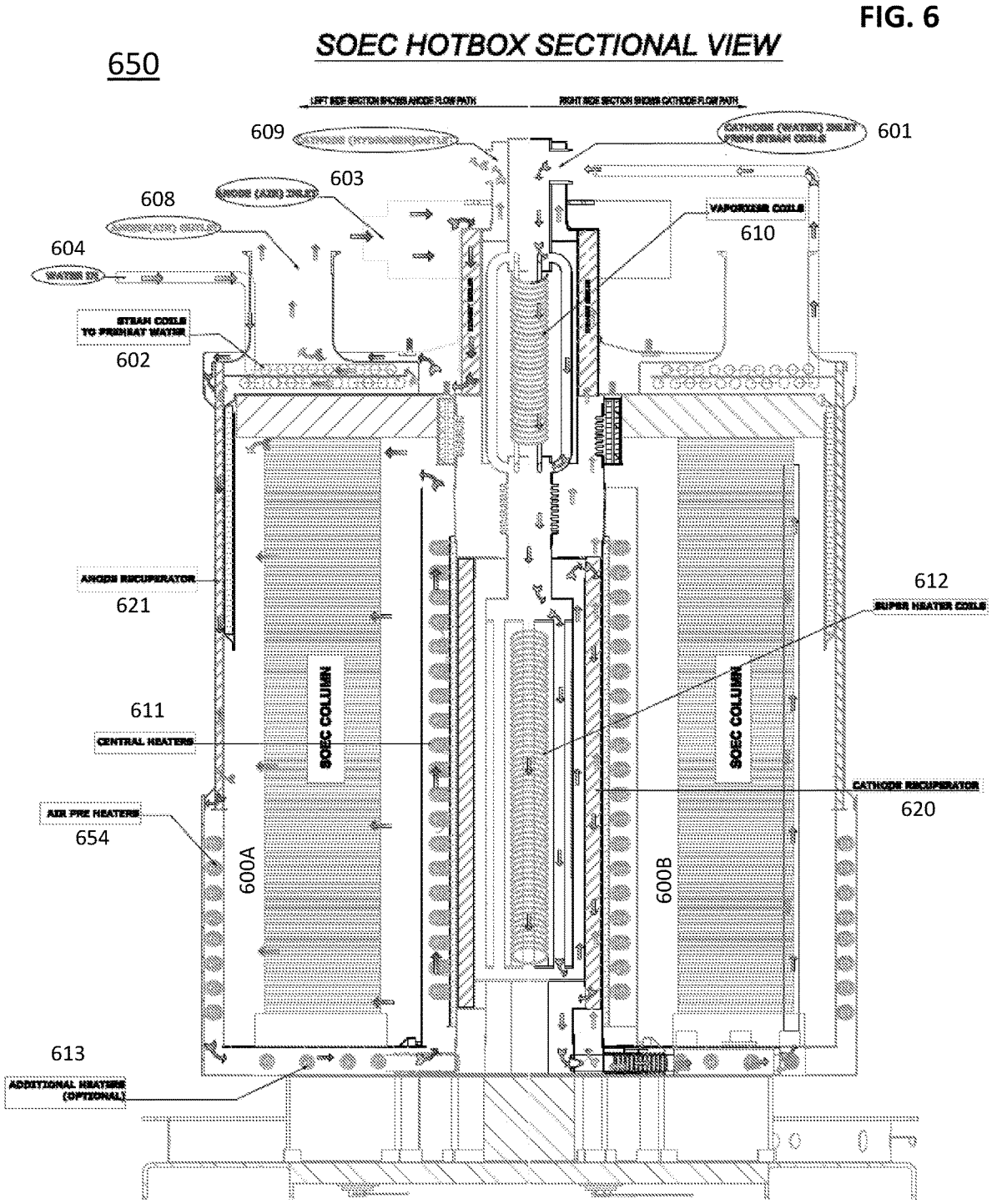
FIG. 6 is a schematic view of a SOEC hotbox according to various embodiments of the present invention.

FIG. 5A illustrates a single vaporizer, and FIG. 5B illustrates a multi-heater array according to various embodiments of the present invention. In the various embodiments, different vaporizing designs and heating elements can be used, such as an immersion type vaporizer, as illustrated in FIG. 5A, or a multi-vaporizer array (or a "multi-heater array"), as illustrated in FIG. 5B. One or more vaporizers can be physically mounted to the hotbox. The mounting to the hotbox can be achieved by attaching either a single vaporizer, or the multi-heater array that converts liquid water feed into saturated or superheated steam. In another example, the vaporizer can be disposed between multiple (e.g., adjacent) stacks 100, as illustrated in FIG. 6. FIG. 6 is a schematic view of a SOEC hotbox 650, having elements as described in connection with FIGS. 1-5. For example, SOEC hotbox 650 includes cathode water inlet 601, water inlet 604, water preheater 602, anode air inlet 603, air preheater 654, anode air outlet 608, cathode hydrogen outlet 609, vaporizer 610, central heaters 611, super heaters 612 (secondary or further heater), optional additional heaters 613, cathode recuperator 620, anode recuperator 621, and stacks 600A, 600B. In yet another example, a stand-alone steam generator (e.g., steam generator 104) can be configured as the vaporizer to the hotbox.

Another aspect of the vaporizer 610, especially internal vaporizers, is the fluid drainage such as at the bottom of a housing of vaporizer 410A, 410B. Returning to FIG. 6, overtime, there could be scaling build up due to contaminants in water, and this would result in poor heat transfer inside the vaporizer. In order to avoid this, a small percentage of inlet water can be drained periodically from the vaporizer 610 to remove scales.

Installation sites for SOEC systems vary in that some have available steam and some do not. Depending on the installation site, the input steam can come from either the internal vaporizer or an external steam source. In some embodiments of the present invention, the electrolyzer system is configured to accommodate input steam from either the internal vaporizer or an external steam source.

Figure 7:
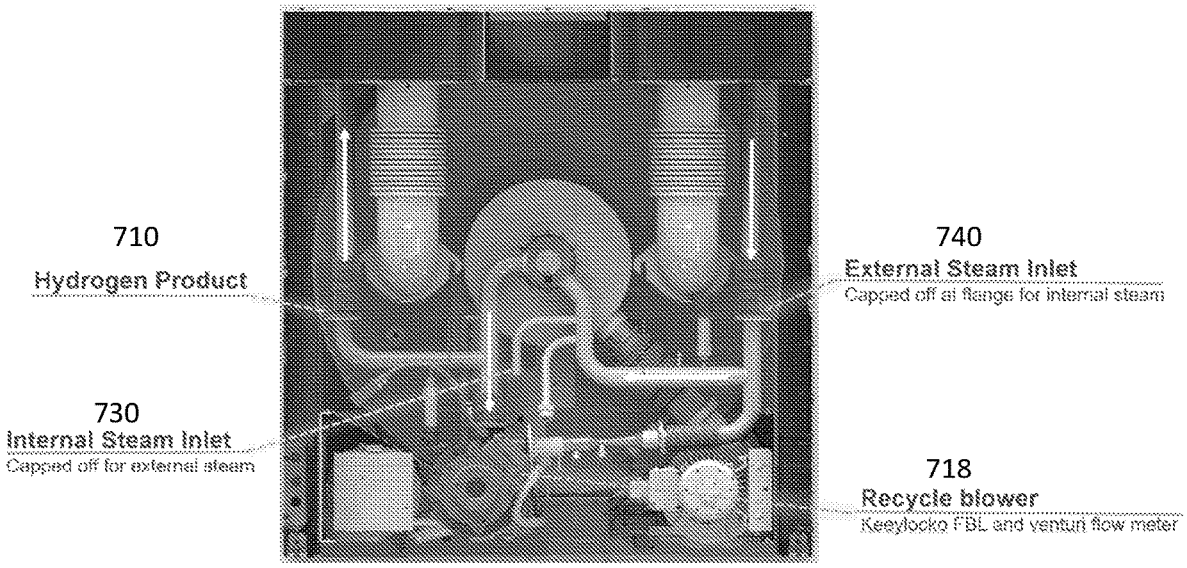
FIG. 7 illustrates a top-perspective view of an electrolyzer steam selector module having steam inlets and recycle loop according to various embodiments of the present invention.

FIG. 7 illustrates a top-perspective view of an electrolyzer steam selector module 700 having steam inlets 730, 740 and a recycle loop according to various embodiments of the present invention. As shown, electrolyzer steam selector module 700 includes hydrogen inlet 710, recycle blower 718, internal steam inlet 730, and external steam inlet 740. Electrolyzer steam selector module 700 enables a choice of either external or internal steam at the time of manufacture.

Figure 8:
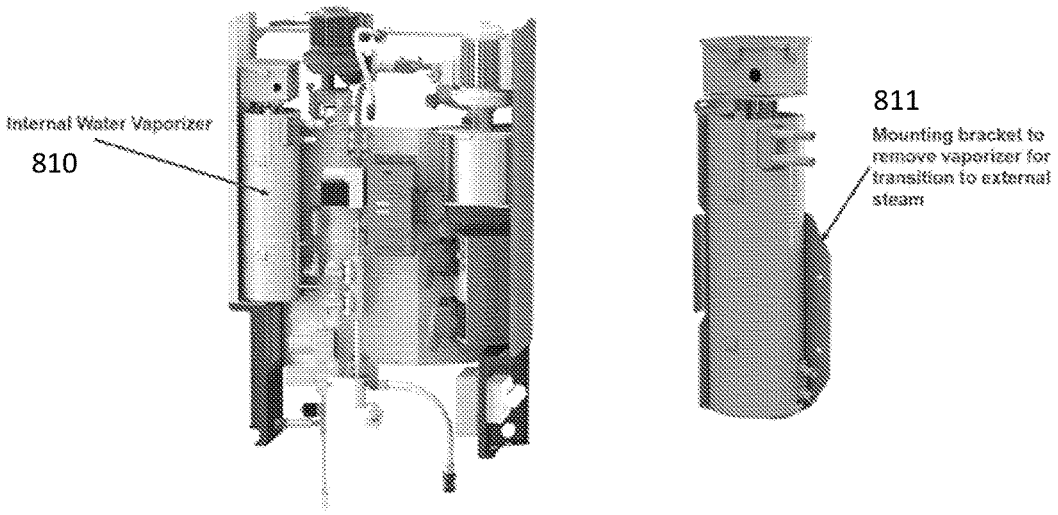
FIG. 8 illustrates a side-perspective view of an electrolyzer steam selector module having a vaporizer according to various embodiments of the present invention.

For an internal steam configuration, a cap, shim, or flange is used to block the external steam inlet 740. Here, the plumbing for the external steam inlet 740 remains in the electrolyzer system and is unused. For an external steam configuration, a cap, shim, or flange is used on the internal steam inlet 730 and the internal vaporizer (e.g., 410, 810) can be removed using the mounting bracket (e.g., 811). FIG. 8 illustrates a side-perspective view of an electrolyzer steam selector module 800 having internal vaporizer 810 according to various embodiments of the present invention. As shown, internal vaporizer 810 may be removed from the electrolyzer steam selector module 800 using mounting bracket 811.

Accordingly, the electrolyzer steam selector module 800, and its modular design, enable the same components to be used with internal vaporizer 810 or an external steam source. As a result, the embodiments enable an internal steam configuration to be installed and then easily switched to an external steam configuration once the architecture for the installation site is developed. Additionally, the electrolyzer steam selector module 800 does not alter the packaging/footprint of the SOEC system, and other configuration specific equipment do not require alteration. It enables manufacturing cost savings due to similar parts used in both configurations. It further saves service costs for the transition between internal and external steam configurations. The units operate as expected without needing configuration unique plumbing.

Figure 9:
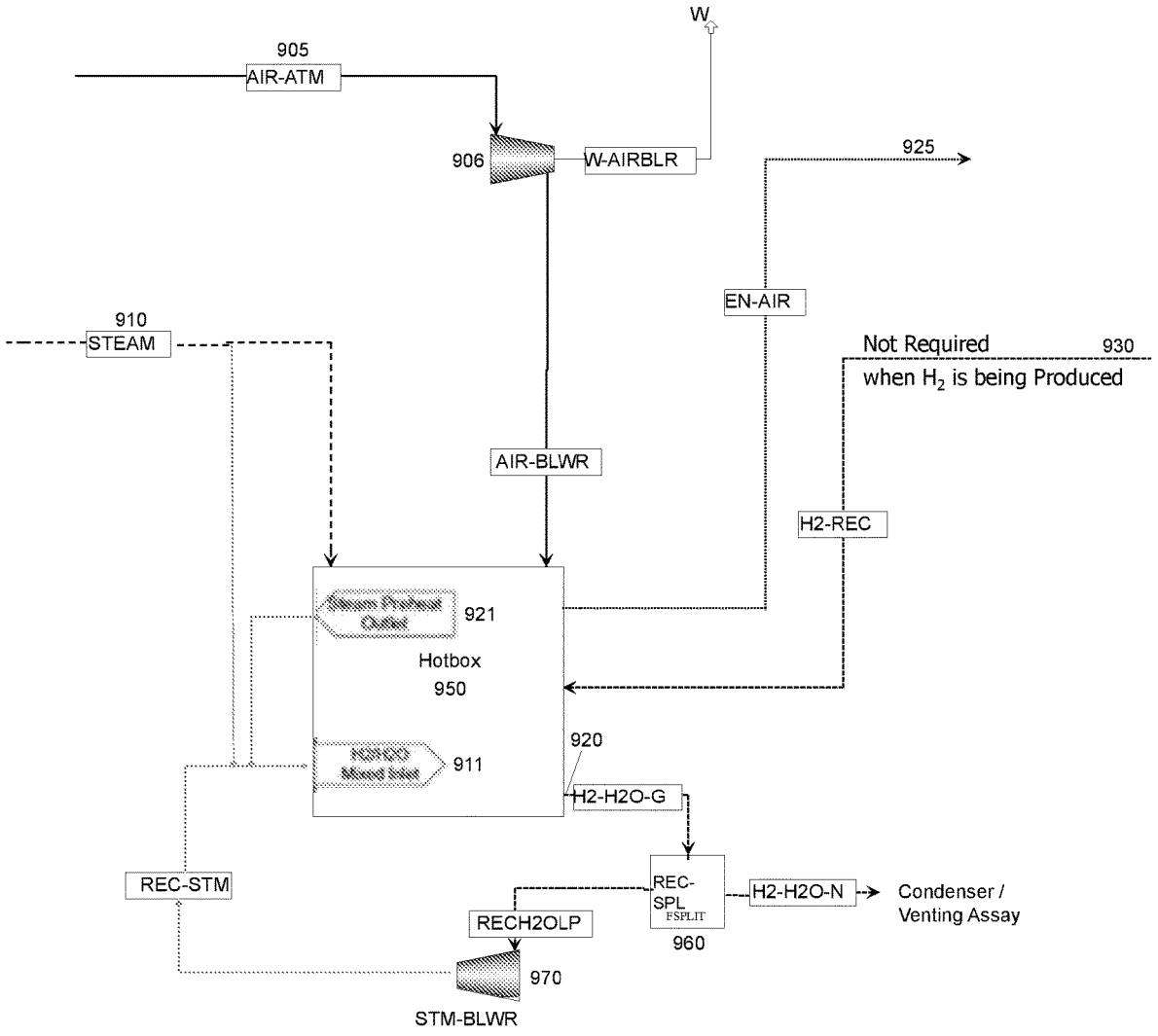
FIG. 9 is an SOEC system 900 according to various embodiments of the present invention.

In some embodiments of the present disclosure, steam is recycled in the SOEC system. FIG. 9 is an SOEC system 900 according to various embodiments of the present invention. As illustrated in FIG. 9, SOEC system 900 includes air conduit 905, air blower 906, steam conduit 910, recycle steam inlet 911, recycle steam outlet 921, hotbox 950, optional hydrogen conduit 930, enriched air conduit 925, steam and hydrogen product outlet 920, splitter 960, and steam recycle blower 970.

According to an example configuration and operation, steam input at steam conduit 910 (e.g., supplying site or facility steam at varying pressures) can have a temperature of between about 100° C. and 110° C. (e.g., 105° C.) and a pressure of about 1 psig. In the various embodiments, steam may be input to the SOEC system 900 from an external source or may be generated locally. Alternatively, or additionally, water may be input to the SOEC system 900 and vaporized.

Air input (e.g., ambient air) at air conduit 905 may be ambient temperature, perhaps between about −20° C. and +45° C., at the local atmospheric pressure. Air from air conduit 905 is received at air blower 906, and air output by air blower 906 will be a slightly higher temperature than ambient due to the heat of compression. For example, the temperature of air output by air blower 906 may be about 30° C. at 1.0 psig as compared to 20° C. ambient air temperature.

Hydrogen from optional hydrogen conduit 930 may only be required for startup and transients when hydrogen is not being otherwise produced by SOEC system 900. For example, there is no longer a need for a separate hydrogen feed stream or hydrogen recycle steam at steady state. Pressure for this hydrogen stream is a design option determined at the time of site construction, and may be between about 5 psig and 3000 psig. The temperature is likely to be near ambient, as it is likely to be coming from storage.

Air input at air conduit 905, steam input at steam conduit 910, and hydrogen input at optional hydrogen conduit 930 are input to hotbox 950. In turn, hotbox 950 outputs steam and hydrogen product $H_2$-$H_2O$-G at steam and hydrogen product outlet 920 of hotbox 950, where G stands for Gross. Hotbox output $H_2$-$H_2O$-G may have a temperature between about 100° C. and 180° C. (e.g., 130° C.), a pressure of between about 0.1 and 0.5 psig.

In addition, hotbox output $H_2$-$H_2O$-G is input to splitter 960 and is split into a steam recycle stream $RECH_2OLP$, where LP stands for low pressure, and a net product $H_2$-$H_2O$—N, where N stands for Net (e.g., output for commercial use or storage). Here, net product $H_2$-$H_2O$—N may have a temperature between about 100° C. and 180° C. (e.g., 130° C.), a pressure of between about 0.1 psig and 0.5 psig. Steam recycle stream $RECH_2OLP$ may have a temperature of between about 100° C. and 180° C. (e.g., 130° C.), a pressure of between about 0.1 psig and 0.5 psig. Hotbox 950 may further output enriched air at enriched air conduit 925 that may have a temperature of between about 120° C. and 300° C., at essentially local atmospheric pressure (e.g., less than 0.5 psig or less than 0.05 psig).

Steam recycle stream $RECH_2OLP$ is input to steam recycle blower 970. The resulting recycled steam REC-STM may have a temperature of between about 100° C. and 180° C. (e.g., 140° C.), a pressure between about 0.5 and 1.5 psig (e.g., about 1 psig), and is input into hotbox 950 at recycle steam inlet 911. Additional steam or heat is supplied to recycle steam inlet 911 by steam recycle outlet 921, which captures air exhaust heat (e.g., ~280° C.) of hotbox 950. In some embodiments, there may be no recycled hydrogen feed included with the recycled steam.

As can be understood from FIG. 9, incoming steam temperature at steam conduit 910 (e.g., 105° C.) is low compared with a SOEC configuration with internal steam generation. A plurality of recycle loops can be configured to SOEC systems using both internal steam generation from recycle steam outlet 921 and external steam generation from steam conduit 910. In other words, recycle steam inlet 911 is configured to receive steam from either steam conduit 910 and recycle steam outlet 921. Here, the embodiments optionally route the facility supplied steam from steam conduit 910, typically saturated and ata temperature of about 105° C., through the internal steam generation coils, one or more vaporizers, and/or other heating elements, and use the air exhaust heat (e.g., ~280° C.) to further heat (i.e., superheat) the steam supply before the heat is released at enriched air conduit 925.

Accordingly, there is approximately, 2-3 kW of energy is available to preheat the steam at recycle steam outlet 921. As a result, the steam temperature into the hotbox is increased to between 140° C. and 160° C.

As discussed above, the example SOEC hotboxes (e.g., 250, 350, 450, 650, 950) include numerous heating elements, such as air preheater 654 (or "primary heater"), central heater 611 (or "secondary heater"), super heater 612 (or "further heater"), optional heater 613, vaporizer 610, etc. Although electrical heaters are widely used in industries for high-temperature heating, heater types and power level are selected for optimal performance of the hotbox. The SOEC hotbox typically utilizes continuous heat input during the startup and steady state operation, and this is enabled using electrical heaters. Accordingly, the embodiments of the invention include some heater configurations for use as primary and/or secondary heaters. Since the thermal uniformity is a key factor, the total heater power (e.g., 30 kW) can be divided into multiple zones (e.g. two zones) and supplied at different locations, such as primary and secondary heaters. It is readily understood that the heater configurations may be readily applied to other heating elements of the SOEC hotbox and system.

FIGS. 10A-E illustrate perspective views of heater configurations according to various embodiments of the present invention.

Figure 10A:
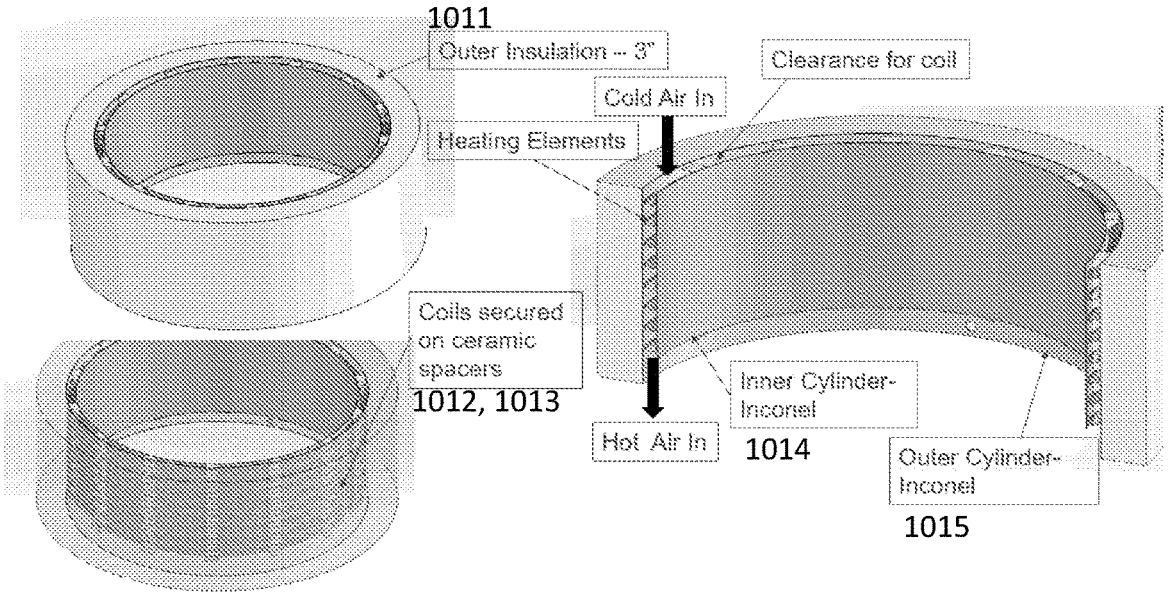
FIGS. 10A-E illustrate perspective views of heater configurations according to various embodiments of the present invention.

As illustrated in FIG. 10A, heater 1010 (e.g., a cylindrical heater) has a multi-layer structure including outer insulation layer 1011 (e.g., 3 inches thick), an outer Inconel layer 1015 located on the inside of outer insulation later 1011, a plurality of heating coils 1012 set apart by a plurality of ceramic spacers 1013, the plurality of heating coils 1012 and plurality of ceramic spacers 1013 being disposed between an inner Inconel layer 1014 and outer Inconel layer 1015 such that cooler air is received and warmer air is output along the spacing between the Iconal layers. Here, the circular heating coils 1012 traverse the circumference of cylindrical heater 1010. Heater 1010 is an example open coil system supported in the ceramic spacer between unishell cylinders.

Figure 10B:
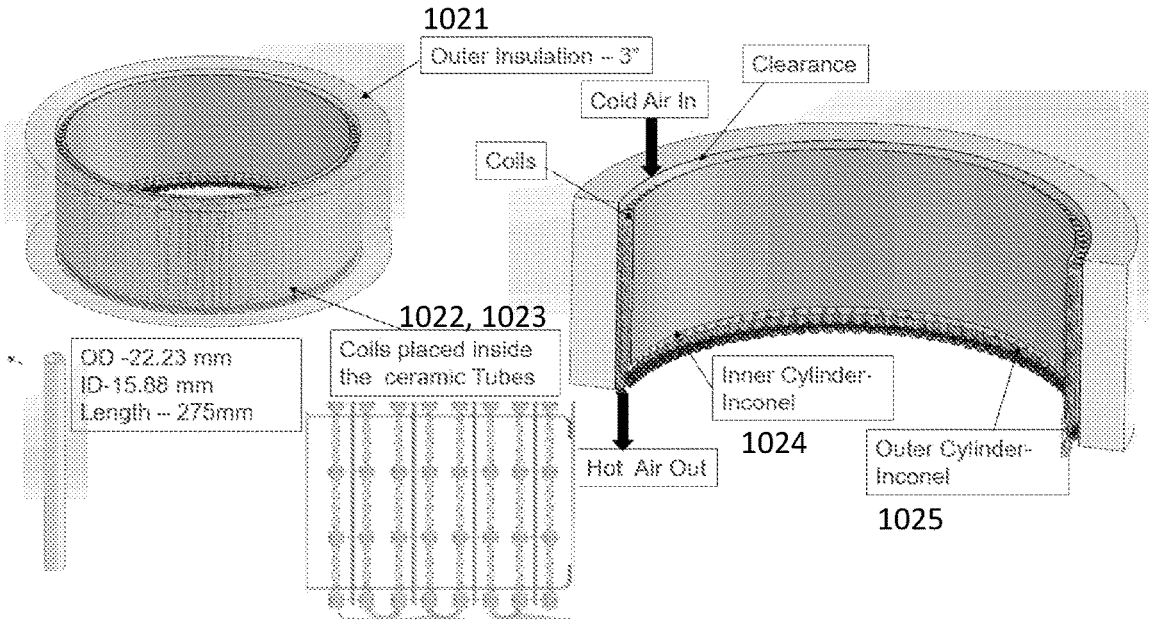
Figure 11A:
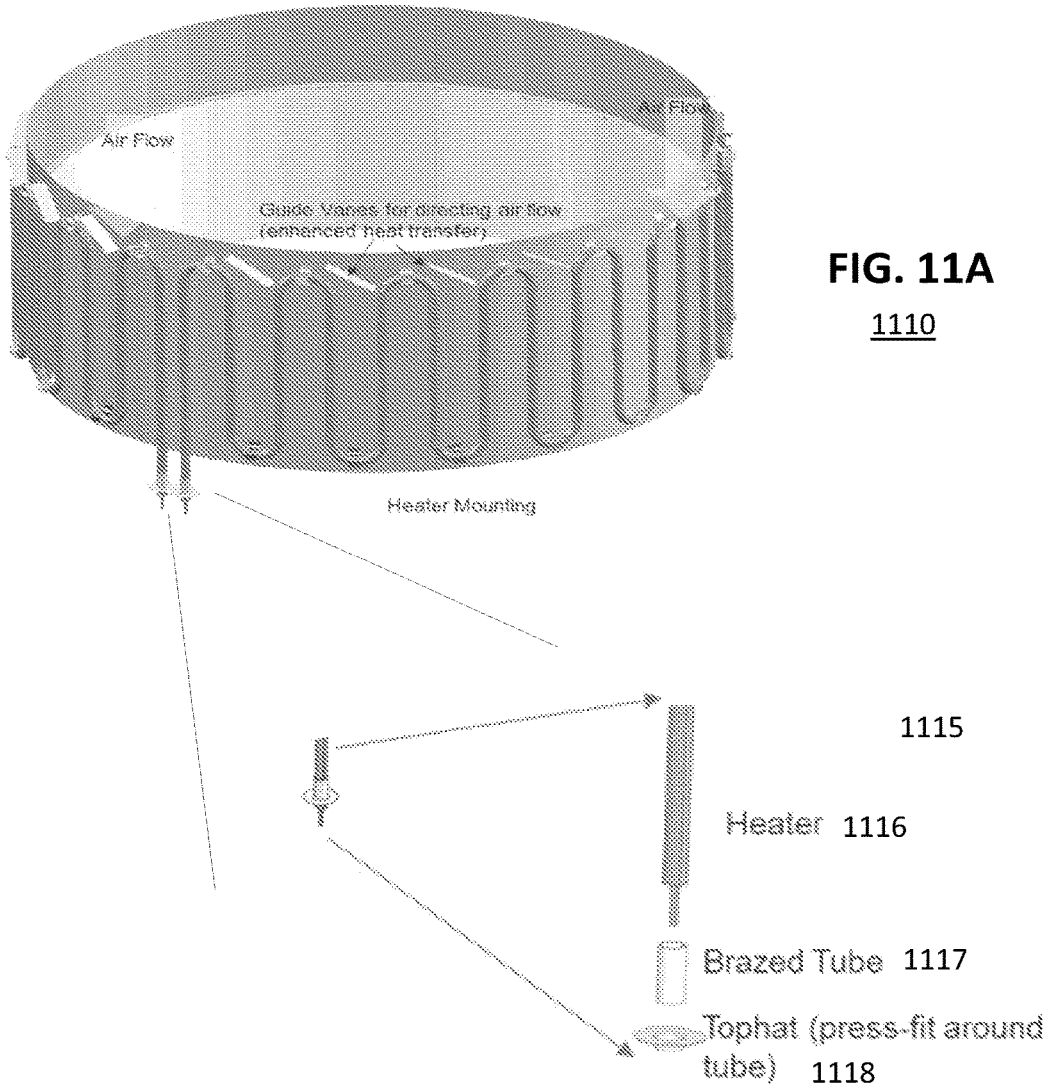
FIGS. 11A and 11B illustrate heater coupling assemblies according to various embodiments of the present invention.

As illustrated in FIG. 10B, heater 1020 (e.g., a cylindrical heater) has a multi-layer structure including outer insulation layer 1021 (e.g., 3 inches thick), an outer Inconel layer 1025 located on the inside of outer insulation later 1021, a plurality of heating coils 1022 set apart by a plurality of ceramic tubes 1023, the plurality of heating coils 1022 and plurality of ceramic tubes 1023 being disposed between an inner Inconel layer 1024 and outer Inconel layer 1025 such that cooler air is received and warmer air is output along the spacing between the Inconel layers. Air flow can be diverted at an angle using guide vanes to enhance heat transfer through heater tubing, as shown in FIG. 11A. Returning to FIG. 10B, the serpentine heating coils (or "heating loops") 1022 traverse the cylindrical heater 1020 in a vertical direction. Heater 1020 is an example open coil system supported in the ceramic tubes. Serpentine coils are shown, but clearly, other geometric patterns are possible.

Figure 10C:
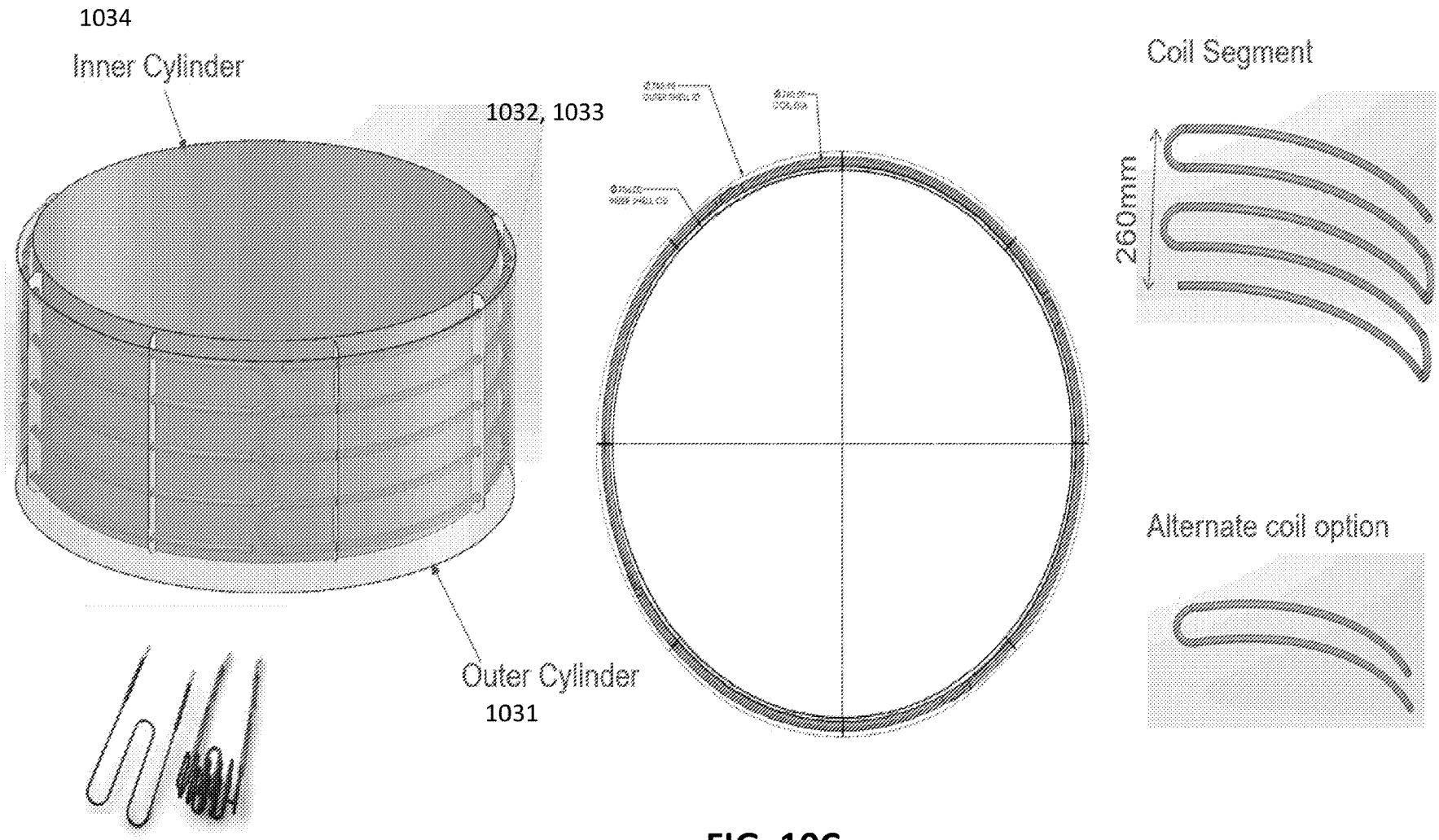
Figure 10D:
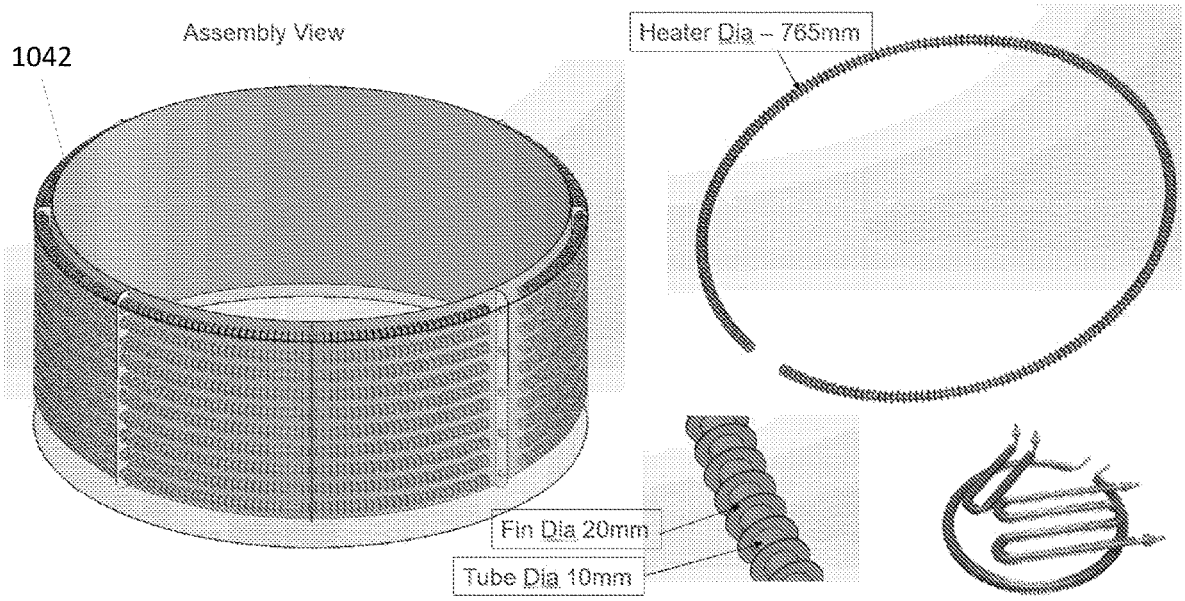

In another example, as illustrated in FIG. 10C, heater 1030 has a multi-layer structure including outer cylinder layer 1031, a plurality of heating coils 1032 set apart by a plurality of mounting brackets 1033 (e.g., sheet metal brackets), the plurality of heating coils 1032 and plurality of mounting brackets 1033 being disposed between an inner cylinder layer 1034 and outer cylinder layer 1031 such that cooler air is received and warmer air is output along the spacing between the inner and outer cylinder layers. Here, the serpentine heating coils 1032 traverse the circumference of cylindrical heater 1030. Numerous coil shapes are feasible, such as U-shaped, M-Shaped, circular, and the like. For example, heater 1040 of FIG. 10D is similar to heater 1030 except for the use of a circular tubular fin-type heating element 1042. Heaters 1030 and 1040 are example tube heaters disposed between metallic cylinders.

Figure 10E:
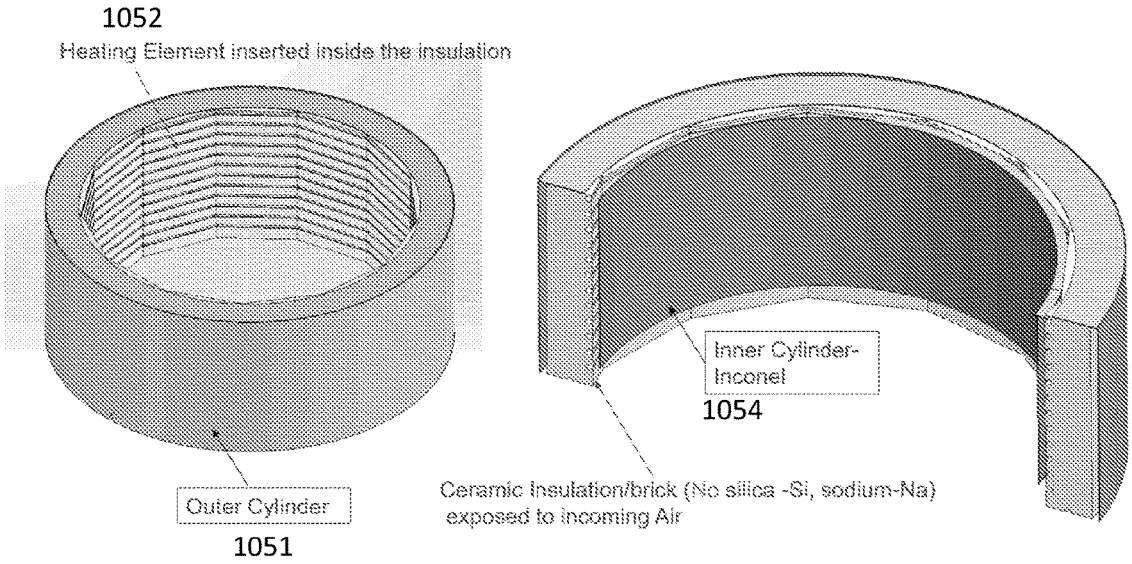

In yet another example, as illustrated in FIG. 10E, heater 1050 has a multi-layer structure including insulation layer 1051, a plurality of heating coils 1052 at least partially disposed within insulation layer 1051, the plurality of heating coils 1512 being disposed between an inner Inconel layer 1054 and outer insulation layer 1051. Heater 1050 is an example coil element inserted inside the ceramic insulation grove (i.e., integrated outer insulation).

FIGS. 10A-E illustrate various heater configurations, but the embodiments are not so limited. Open coil designs can run continuously at very high temperature and are suitable for SOEC hotbox applications. If metallic cylinders are used, there is risk of electrical shorting with the metallic outer cylinders that is readily solved using an insulation material or coating. Alternatively, tube heaters can be used without any additional insulation, but the maximum operating temperature may be limited to a nominal maximum temperature, e.g. 900-1000 C or 920-940° C.

Figure 11B:
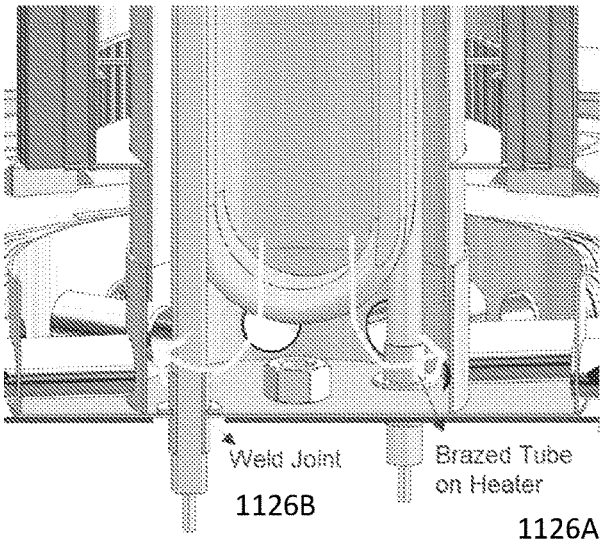

FIGS. 11A and 11B illustrate heater coupling assemblies 1115 according to various embodiments of the present invention. As illustrated in FIG. 11A, cylindrical heater 1110 includes heater coupling assembly 1115. Heater coupling assembly 1115 includes a distal end of heating coil 1116, brazed tube 1117, and press-fit tophat 1118. Brazed tube 1117 goes over heating coil 1116 and is brazed onto it. This provides more material to ensure the physical integrity of the heating coil 1116 during press-fitting with tophat 1118, as shown by the coupling of heater 1120 at 1126A of FIG. 11B. Brazed tube 1117 also can be used for direct welding or inserting through a top-hat, which can then be secured on to the base of the hotbox, as shown by the coupling of heater 1120 at 1126B of FIG. 11B.

Figure 12A:
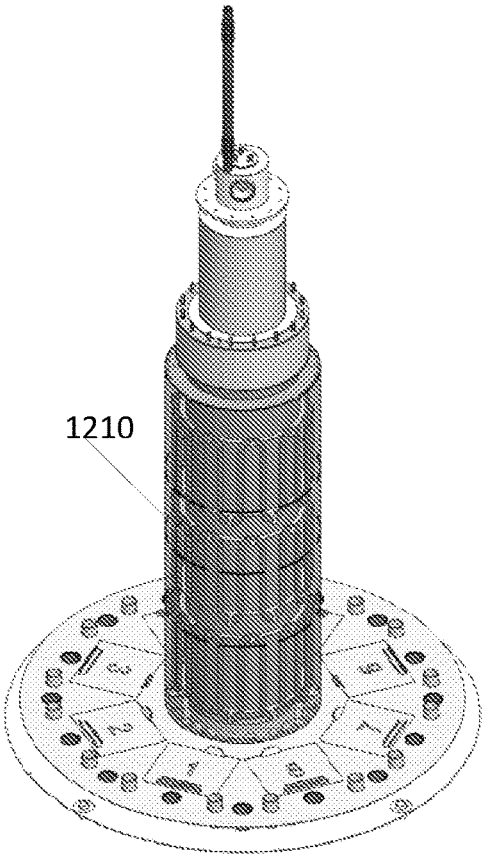
FIGS. 12A and 12B illustrate heater assemblies for an anode tailgas region according to various embodiments of the present invention.
Figure 12B:
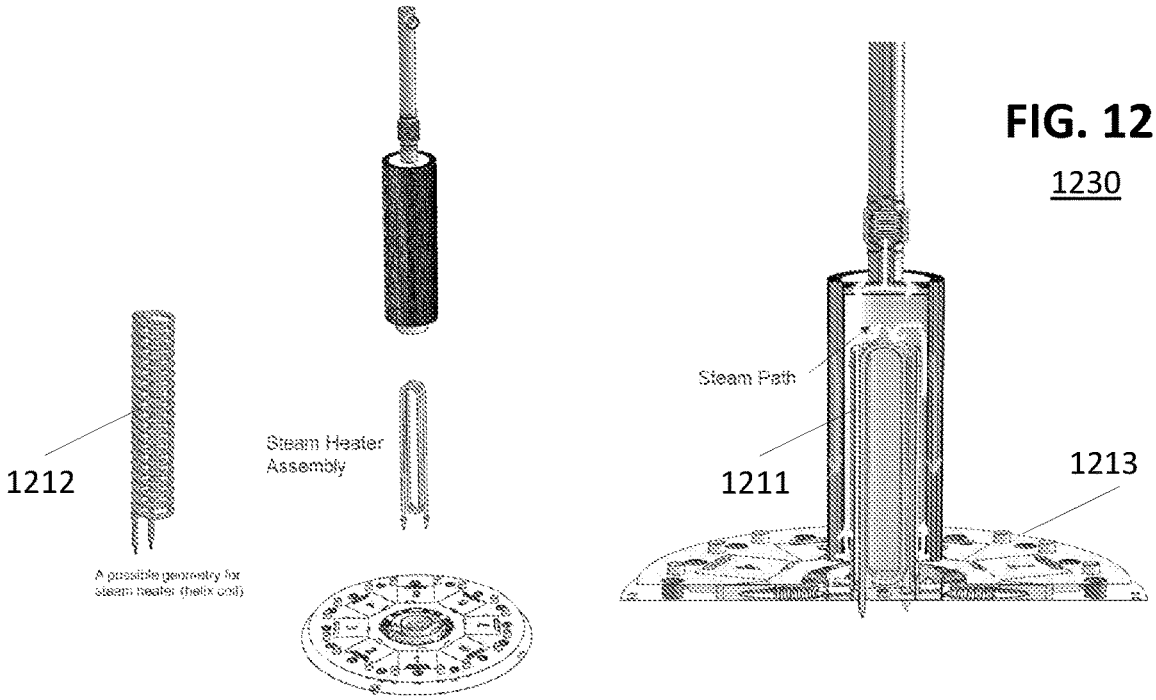

FIGS. 12A and 12B illustrate heater assemblies for a steam heat region 1230 according to various embodiments of the present invention. As discussed above, heaters (e.g., 1020, 1110) may utilize heater loops that are vertically oriented relative to the cylindrical housing. Similarly, vertically-oriented heater loops can be used inside the steam heat region (e.g., within ATO 330 in SOFC) to directly heat stacks and/or fuel cell columns as shown in FIG. 12A. Here, the heater loops are vertically oriented and mounted on the outer surface of the cylindrical housing. For example, the steam heat region 1230 can include a plurality of rows of vertically oriented heater loops 1210. As illustrated in FIG. 12B, heater 1211 is disposed within the steam path of 1230. Various heater configurations are feasible, such as helix coil 1212. Regardless of which heater configuration is used, the terminals of the heater should be shielded from steam to ensure heater reliability. Using the coupling assembly 1115, as discussed in connection with FIGS. 11A and 11B, steam should remain above base plate 1213.

It will be apparent to those skilled in the art that various modifications and variations can be made in the vaporizer and external steam for solid oxide electrolyzer of the present invention without departing from the spirit or scope of the invention. Thus, it is intended that the present invention cover the modifications and variations of this invention provided they come within the scope of the appended claims and their equivalents.

What is claimed is:

1. An electrolyzer system comprising:

a hotbox;

stacks of electrolyzer cells disposed within the hotbox;

an exhaust conduit that is configured to receive an exhaust output by the stacks;

steam plumbing disposed on top of the hotbox and configured to provide steam to the hotbox, the steam plumbing comprising an external steam inlet configured to receive the steam from an external steam source, an internal steam inlet configured to receive the steam from a vaporizer removably mounted to an outer surface of the hotbox, and a cap, shim, or flange blocking one of the external steam inlet or the internal steam inlet; and a recycling loop that fluidly connects the exhaust conduit to the steam plumbing.

2. The electrolyzer system of claim 1, further comprising a steam recycle blower located on the recycling loop and configured to recycle the exhaust output from the hotbox to the steam plumbing.

3. The electrolyzer system of claim 1, wherein the cap, shim, or flange blocks the internal steam inlet, and the external steam inlet is fluidly connected to an external steam generator.

4. The electrolyzer system of claim 1, further comprising a vaporizer that is removably mounted to an outer surface of the hotbox by a mounting bracket and is configured to supply the steam to the steam plumbing, wherein the cap, shim, or flange blocks the external steam inlet.

5. The electrolyzer system of claim 4, wherein the vaporizer comprises a multi-vaporizer array.

6. The electrolyzer system of claim 1, further comprising a steam recycle blower configured to recycle a portion of the exhaust comprising a hydrogen and steam exhaust stream flowing through the recycling loop to the steam plumbing.

7. The electrolyzer system of claim 6, further comprising a splitter that is fluidly connected to the exhaust conduit, and that is configured to supply the portion of the hydrogen and steam exhaust stream to the steam recycle blower.

8. The electrolyzer system of claim 1, wherein the stacks of electrolyzer cells are configured to receive the steam and hydrogen.

9. The electrolyzer system of claim 1, wherein the stacks of electrolyzer cells are configured to receive external hydrogen from an external hydrogen source during startup, shutdown, or when the electrolyzer system is not producing hydrogen.

10. The electrolyzer system of claim 9, wherein the stacks of electrolyzer cells are configured to cease receiving the external hydrogen when the electrolyzer system is operating at steady state.

11. The electrolyzer system of claim 1, further comprising a primary heater and a secondary heater internal to the hotbox.

12. The electrolyzer system of claim 11, wherein each of the primary heater and secondary heater has an open-type coil structure.

13. The electrolyzer system of claim 1, further comprising a heater internal to the hotbox having serpentine loops that are vertically oriented.

* * * * *